US005669449A

United States Patent [19]

Polan et al.

[11] Patent Number: 5,669,449

[45] Date of Patent: Sep. 23, 1997

[54] DIRECTIONAL SPRINKLERS

[75] Inventors: George S. Polan, Perkiomenville; James E. Golinveaux, North Wales; Stephen J. Meyer, Malvern, all of Pa.

[73] Assignee: Central Sprinkler Co., Lansdale, Pa.

[21] Appl. No.: 395,270

[22] Filed: Feb. 28, 1995

[51] Int. Cl.[6] ..... A62C 35/68

[52] U.S. Cl. ..... 169/16; 169/37; 169/38; 169/39; 169/40

[58] Field of Search ..... 169/37, 38, 39, 169/40, 41, 16

[56] References Cited

U.S. PATENT DOCUMENTS

| | | | |
|---|---|---|---|
| 416,838 | 12/1889 | Harder . | |
| 963,354 | 7/1910 | Braemer | 169/37 |
| 1,614,002 | 1/1927 | Horton | 169/39 |
| 1,891,183 | 12/1932 | Rowley . | |
| 2,961,040 | 11/1960 | Wolters | 169/37 |
| 3,195,647 | 7/1965 | Campbell et al. | 169/37 |
| 3,837,405 | 9/1974 | Huddle | 169/16 |
| 3,904,126 | 9/1975 | Allard | 239/502 |
| 4,175,703 | 11/1979 | Valiant | 169/16 |
| 4,585,069 | 4/1986 | Whitaker | 169/37 |
| 4,953,623 | 9/1990 | Applegate | 169/37 |
| 4,964,574 | 10/1990 | Daigle | 239/589 |

FOREIGN PATENT DOCUMENTS

| | | | |
|---|---|---|---|
| 650410 | 11/1964 | Belgium | 169/37 |
| 711855 | 9/1931 | France | 169/16 |
| 291051 | 5/1953 | Switzerland | 169/16 |

OTHER PUBLICATIONS

Data Sheet "Upright Elongated Spray Nozzle Model F950/Q-54 . . . ", TD721, Grinnell Corporation, Jul. 1986 (4 pages).

Data Sheet "Upright Elongated Spray Nozzles Model FR-1/Q-54 . . . ", TD720, Grinnell Corporation, Sep. 1988 (4 pages).

*Primary Examiner*—Gary C. Hoge

*Attorney, Agent, or Firm*—Panitch Schwarze Jacobs & Nadel, P.C.

[57] ABSTRACT

Directional sprinklers include a sprinkler body with a water directing structure configured to direct water passing from an outlet of the sprinkler body in one or more distinct and different directions. Water directing structures are disclosed in the form of deflectors having one or two separate water directing channels and hollow heads having at least two separate nozzles facing in two distinct and different directions. The channels and nozzles can be configured to direct water in diametrically opposing directions, mutually perpendicular directions or at any other desired orientation with respect to one another and to direct the water radially outwardly from the centerline of the sprinkler body outlet or at any predetermined transverse angle to that centerline. The throw of each channel and nozzle is longer than it is wide so that water is discharged over a generally rectangular or elliptical area in each direction. Different unidirectional and bidirectional downwardly discharging, upright sprinkler embodiments are disclosed particularly for use under pitched roofs, hipped roofs, dormers, interior cathedral ceilings and other pitched overhead interior walls.

34 Claims, 8 Drawing Sheets

DIRECTIONAL SPRINKLERS

FIELD OF THE INVENTION

The present invention relates to automatic fire sprinklers and to directional sprinklers, in particular.

BACKGROUND OF THE INVENTION

Pitched overhead walls in buildings hold special challenges for fire sprinkler systems, particularly where beams, trusses or joists project from or are otherwise exposed beneath the lower side of the overhead wall, which may be an interior cathedral-type ceiling or the lower deck of a pitched roof.

NFPA 13, the National Fire Protection Association standard for the installation of sprinkler systems, directs sprinkler systems installed beneath pitched overhead walls to be treated generally the same as sprinkler systems installed beneath horizontal overhead walls. Sprinklers are mounted beneath a pitched overhead wall on supply lines which may run perpendicular or parallel to the peak. Spacings between the supply lines and between individual sprinklers on the lines and protection areas per sprinkler, which are recognized as adequate by the standard for the fire hazard in question (light, ordinary or extraordinary), are to be used. Under light hazard conditions, adjoining sprinklers and supply lines may be as far as fifteen feet apart, with each sprinkler allocated a floor space of up to 225 square feet (15×15) to protect. For ordinary or extraordinary hazards, the protection area per sprinkler is reduced to between about 100 and 130 square feet with appropriate reductions in the spacings between individual sprinklers and supply lines to provide such average coverage.

Where conventional automatic ceiling sprinklers are employed, the sprinklers are mounted with their deflectors pitched to parallel the pitch of the overhead wall beneath which they are installed. An exception is made if a sprinkler is installed directly beneath the peak of a pitched roof. Its deflector may be oriented horizontally. Another exception is provided for sprinklers that are located in or near the peak, rather than directly under the peak. The deflectors of these sprinklers are to be no more than three feet vertically down from the peak except on a steeply pitched roof where the distance may be increased to assure a horizontal clearance of not less than two feet from other structural members on either side of the sprinkler. Apart from these restrictions, sprinklers are permitted to be installed otherwise in accordance with their listings with respect to their spacing from one another and along branch lines and with respect to the spacing of their deflectors from the overhead wall.

Conventional sprinkler protection practice, as embodied in NFPA 13, is directed to controlling fires occurring beneath the sprinklers and not to controlling fires which may occur above the sprinklers.

Certain types of sprinklers, commonly referred to as "old-style" sprinklers, have deflectors which distribute water both upwardly and downwardly from the sprinkler to provide some degree of overhead protection. However, NFPA 13 specifically prohibits the use of old-style sprinklers in new installations "except when constructions features or other special situations require unique water distribution."

While NFPA 13 inferentially permits the use of old style sprinklers under pitched roofs, many municipalities prohibit the use of old style sprinklers in any new installations, regardless of whether such sprinklers may or may not prove beneficial under the circumstances. In addition, old style sprinklers are available from only a limited number of sprinkler manufacturers in the United States and generally only in a light hazard ceiling configuration which permits 15×15 foot spacings and 225 square foot protection areas.

Applicants have found in actual fire tests that the installation of conventional, modern ceiling sprinklers in pitched roofs in accordance with NFPA 13, can permit secondary fires to start and burn above the sprinklers, particularly in areas in the peak of the roof or a cathedral ceiling, which is not adequately protected by conventional sprinklers installed in accordance with NFPA 13 requirements. This has been found particularly true where structural members such as beams, joists, trusses or the like project downwardly from the deck of the pitched overhead wall to form courses. Courses direct heated air from a fire straight up the pitched portion of the ceiling or roof to the peak. The deflectors of standard ceiling sprinklers are configured to direct the water released by the sprinkler essentially downward in a fairly restricted cone. Accordingly, it is often difficult or impossible to even locate such sprinklers in a way which conforms with NFPA-13 and in which their discharge is directed into one of the channels to fully cover the channel and cool any heated air which may be rising through the channel.

Applicants have attempted to overcome this problem by installing standard sidewall sprinklers at the peak of a pitched test roof. Sidewall sprinklers differ from ceiling sprinklers primarily in their deflectors and resulting spray distribution patterns. The spray distribution patterns of ceiling sprinklers are generally symmetric and conical with respect to a centerline of the sprinkler, entirely around the sprinkler. Sidewall sprinklers discharge primarily outwardly from one side or end of the sprinkler. Conventional sidewall sprinklers provide a water distribution in which the outward (longitudinal) throw of Water is greater than the lateral spread of the water, resulting in an "elliptical" or "rectangular" distribution pattern.

When pairs of conventional sidewall sprinklers were installed in the peak of a pitched test roof, each sprinkler directed to throw its water down a separate one of the two courses which come together at the peak, it was found impossible to locate such sidewall sprinklers in a way in which the spray from one would not cover the other, cooling the other sprinkler and preventing its activation. Furthermore, in a significant number of instances, the sidewall sprinkler directed down the wrong course would activate first and would prevent the proper fire suppressing sidewall sprinkler from ever activating.

It is believed that there is a distinct and significant need for better fire protection for pitched overhead walls such as cathedral-type ceilings and the lower sides of pitched roofs.

SUMMARY OF THE INVENTION

In one aspect, the invention is a directional sprinkler which comprises: a tubular body having an inlet, an outlet with a central axis and a waterway coupling the inlet and the outlet; a plug releasably received in the waterway at the outlet at least essentially closing the outlet; a temperature responsive trigger releasably retaining the plug in the outlet; and a water directing structure coupled with a tubular body so as to receive water flowing from the outlet when the plug is released by the trigger. The water directing structure has at least two separate and distinct water directing channels configured and positioned to divide and direct water from the outlet outwardly from the sprinkler simultaneously in two distinct and different directions, the water directing structure dividing water from the tubular body substantially equally among all of the water directing channels, each channel having a water directing surface generally facing the tubular body, a tangential line projecting from a central point on each downwardly facing water directing surface most remote from the central axis intersecting the central axis at an acute angle of greater than 45° and less than 90°.

A sprinkler system used beneath an interior overhead wall having a peak defined by an intersection of at least two adjoining pitched portions of the overhead wall extending downwardly and outwardly from the peak comprising: a water supply line located beneath and proximal to the peak; and a plurality of sprinklers coupled to the supply line and located beneath the peak proximal the peak, each of the sprinklers having two distinct and separate water directing channels configured and oriented with respect to the peak to direct water outwardly from each sprinkler simultaneously and continuously in two distinct and different directions extending downwardly and outwardly from the sprinkler and from the peak and at least generally along each of the two adjoining pitched portions of the overhead wall.

In yet another aspect, the invention is a sprinkler system installed in a building with a hipped roof.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
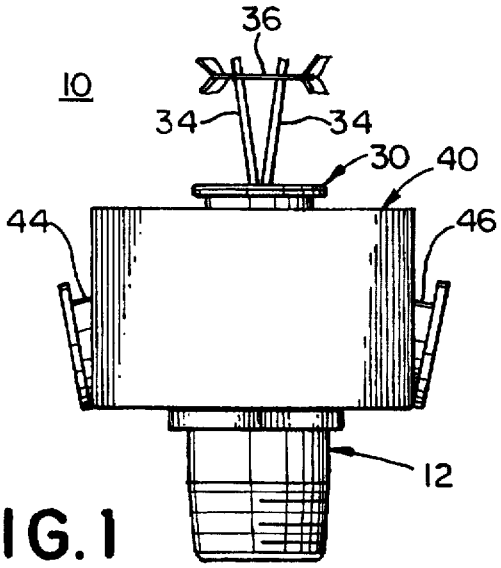
FIG. 1 is a side elevational view of a first embodiment bidirectional sprinkler of the present invention.
Figure 2:
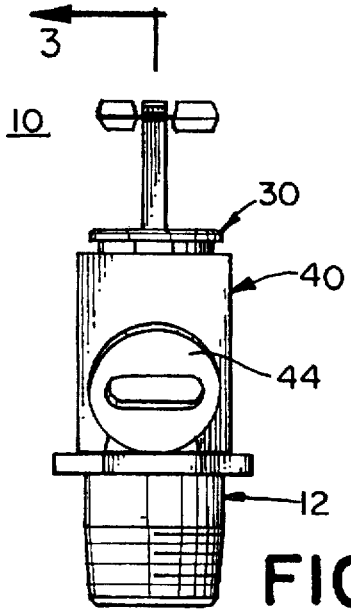
FIG. 2 is a second side elevational view of the sprinkler of FIG. 1 rotated 90° in a horizontal plane.
Figure 3:
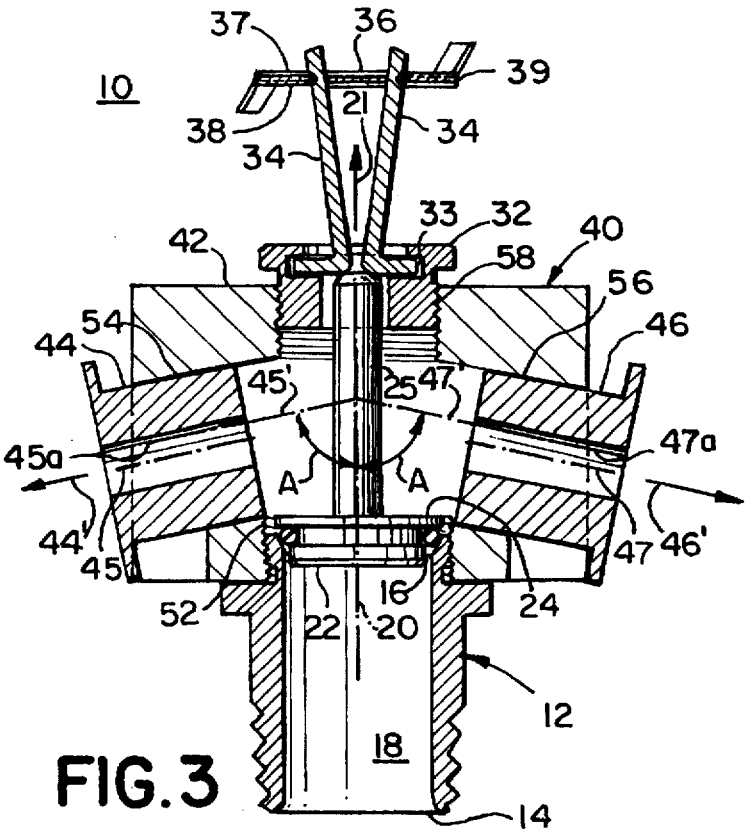
FIG. 3 is an elevational view of the sprinkler of FIGS. 1 and 2 sectioned, but for the plug assembly, along the lines 3—3 of FIG. 2.

Referring first to FIGS. 1 through 3, there is shown a first embodiment bidirectional or "paired sidewall" sprinkler of the present invention indicated generally at 10 comprising a hollow tubular sprinkler body indicated at 12 having an inlet 14 and outlet 16 and a waterway 18 coupling the inlet and the outlet. A plug assembly 22 is releasably received in the waterway at the outlet and at least essentially closes the waterway 18. A temperature responsive trigger 30 releasably retains the plug assembly 22 in the waterway in a manner to be described. The trigger 30 releases the plug assembly 22 after the trigger 30 has been heated to a predetermined temperature above room temperature. A water directing structure, which is indicated generally at 40, is fluidly coupled with the outlet 16.

Preferably the sprinkler 10 is generally of an upright type, meaning that the sprinkler body is installed so as to discharge water from outlet 16 in an upwardly direction. When the sprinkler 10 is installed in this orientation, the trigger 30 is located at the top of the sprinkler 10, where it is closer to heat trapped beneath an overhead wall. Structure 40 receives a water column flowing from outlet 16 when plug assembly 22 is released by trigger 30. The water column has a centerline coincident with central axis 20 of the outlet 16. The direction of discharge of the water column is indicated by arrowed line 21 coincident with central axis 20. The water directing structure 40 is configured to substantially equally divide and direct water outwardly from the water column (central axis 20) and the sprinkler 10 simultaneously and continuously in at least two distinct and separated distributions in two distinct and different directions by containing all of the watered discharged by the outlet 16 and releasing it only through a pair of generally identical nozzles 44, 46 generally symmetrically positioned with respect to the outlet of the tubular body.

Structure 40 preferably comprises a hollow member or head 42 physically coupled with an outlet end of body 12 by suitable means such as a threaded bore 52 receiving a threaded outlet end of body 12. Head 42 supports the trigger 30 and preferably substantially identical first and second discharge nozzles 44 and 46. Each nozzle 44 and 46 has a fluid passage 45 and 47. Each of the discharge nozzles 44 and 46 defines a distinct and separate, fully enclosed, water directing channel. Each nozzle 44, 46 is configured and positioned to direct part of the water column issuing vertically from outlet 16 into head 42 in one of the two distinct and different downward and outward directions indicated by arrowed lines 44' and 46', respectively. Preferably, directional lines 44' and 46' are coincident with centerlines of the first and second nozzles 44 and 46, more particularly the fluid passages 45 and 47 of the nozzles 44, 46, and are further coplanar and symmetric with respect to the central axis 20 of the outlet 16. Each fluid passage 45 and 47 has a water directing surface, indicated generally at **45*a* and 47*a* respectively, which generally faces downward, towards the tubular body, and which is most instrumental in directing the water discharged by the sprinkler downwardly and outwardly away from the sprinkler. The centerlines 45' and 47' of the water directing surfaces 45*a* and 47*a* preferably intersect central axis 20 when extended to the central axis from the outer end of the nozzle most remote from the central axis 20. Preferably, such projecting centerlines 45' and 47' intersect the central axis 20 at equal included angles A facing the outlet 16, which are greater than 45° and less than 90°. Directional lines 44' and 46' and centerlines 45', 47' of the water directing surfaces 45*a* and 47*a* are all preferably coplanar with the central axis 20, all lying in the plane of FIG. 3. Nozzles 44 and 46 are preferably frictionally engaged in bores 54 and 56 of the head 42**, respectively, but may be mounted in other ways or machined into the head (not depicted).

Figure 19A:
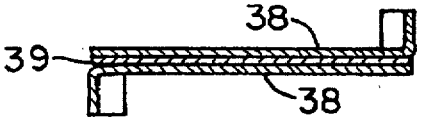
FIG. 19A is a cross-sectional view taken along the lines 19A—19A of FIG. 19.
Figure 19:
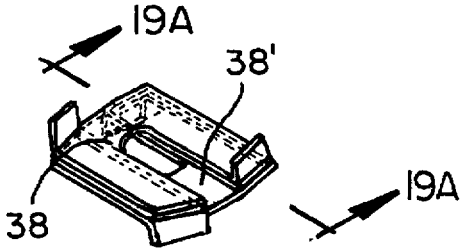
FIG. 19 is a perspective view of a pair of joined links forming the trigger.

A threaded bore 58 opposite outlet 16 receives a threaded ring member 32 of the trigger 30. Trigger 30 preferably includes, in addition to threaded ring member 32, a pair of preferably identical, generally L-shaped levers 34. Short arms of the levers 34 preferably are received in an inner, annular groove 33 provided in the ring member 32. Long ends of the levers 34 preferably are held together by a thermally responsive element 36, which is preferably formed from a pair of identical, reversely positioned, generally U-shaped members or links 38, 38'. Links 38, 38' preferably are held together by an intermediate layer 39 of a selected, thermally responsive material, preferably a selected low temperature melting solder as separately shown in FIGS. 19 and 19A for clarity. Levers 34 releasably retain plug 24 in the outlet 16 by pressing against a pin 25, which extends axially away from a plug 24 of the plug assembly 22. Plug 24 at least closes and preferably seals the outlet 16 and waterway 18.

Bidirectional sprinkler 10 is preferably assembled by mounting nozzles 44 and 46 to the head 42, inserting the plug assembly 22 and the outlet 16 end of sprinkler body 12 into threaded bore 52 of the body 42 and mounting the trigger 30 to the opposing bore 58 of the body 42, tightening the threaded ring member 32 down sufficiently to sealingly seat plug 24 of the assembly 22 in the outlet 16. Alternatively, the member 32 of trigger 30 can be tightened first and the sprinkler body 12 can be tightened into head 42 to seat plug 24.

Figure 5:
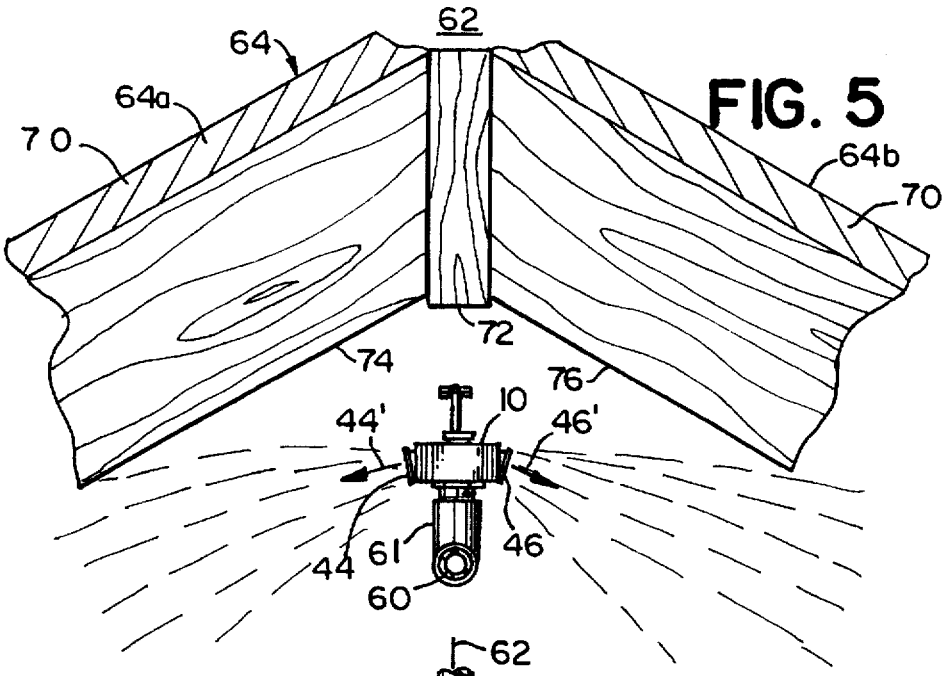
FIG. 5 is an end view of one of the first embodiment sprinklers of FIGS. 1 through 3 installed beneath the peak of a pitched roof.
Figure 6:
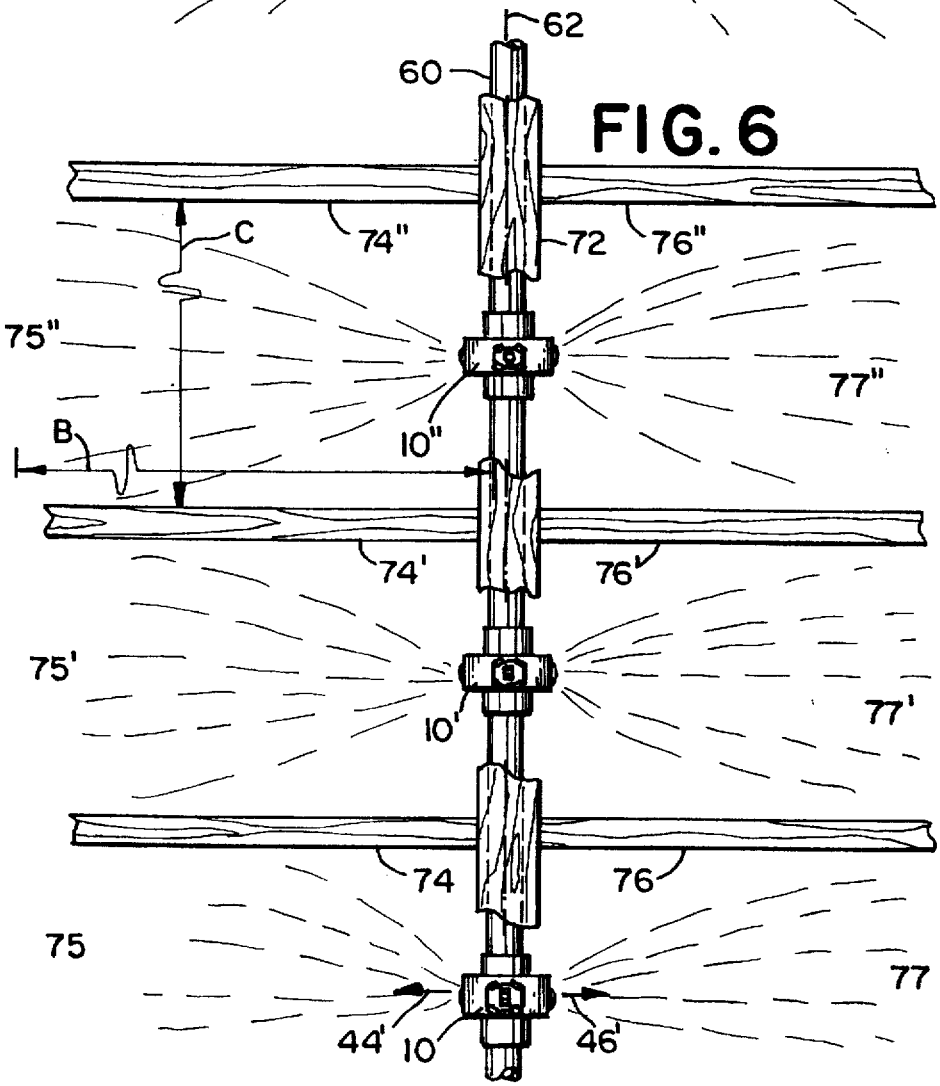
FIG. 6 is an overhead view of the installation of FIG. 5.

FIGS. 5 and 6 depict diagrammatically a preferred installation of identical bidirectional sprinklers 10, 10' and 10" of the present invention supported on a water supply line 60 running beneath the peak of an interior overhead wall 64 within a building. The peak 62 is defined by the intersection of two adjoining pitched portions **64*a*, 64*b* of the overhead wall 64, which extend generally downwardly and outwardly from the peak 62. Each of the sprinklers 10, 10' and 10" is positioned proximal and beneath the peak 62 and is oriented such that the discharge nozzles 44 and 46 of each sprinkler are directed transversely and preferably perpendicularly outwardly from the peak, indicated by line 62 in FIG. 6. In this particular example, the overhead wall 64 is the roof of the building and the pitched portions 64*a*, 64*b* are defined by deck pieces 70, which are in turn supported by and typically attached to center beam 72 and to opposing joists 74, 76, which intersect and are secured to the center beam 72**.

FIG. 6 is a top plan view through the roof of the sprinkler system of FIG. 5 with all of the decking omitted and portions of the center beam 72 broken away for clarity. Each sprinkler 10, 10', 10" is coupled to the water supply line 60 by suitable means in a conventional fashion, for example, by being threaded into a tee 61 or into a stem (not depicted) coupled with the tee 61. Supply line 60 would be supported from the roof in a conventional fashion, for example, from the center beam by hangers or straps, which are omitted from the figures for clarity of the remaining views. One of ordinary skill will appreciate that the scale in FIG. 6 is badly distorted in order to show several successive sprinklers. Preferably each of the successive sprinklers 10, 10', 10" is located along the supply line 60 and along the peak 62 so that each is at least generally centered with respect to a separate one of successive adjoining pairs of opposing courses in the form of joist channels 75'/77'; 75"/77", etc. which are defined by the decking 70, center beam 72 and adjoining pairs of joists 74, 74'/76, 76', etc. Preferably too, the distinct and different directions 44' and 46' are oriented in a way to extend generally downwardly and outwardly from each sprinkler 10, 10', 10" and the peak 62, generally along each of the adjoining pitched portions **64*a*, 64*b* of the overhead wall and the opposing joist channels 75/77. Preferably, directions 44' and 46' extend at least generally along and preferably at least roughly parallel to or slightly into the pitched portions 64*a*, 64*b* of the overhead wall 64 sufficiently so as to wet the two pitched portions 64*a*, 64*b* of the overhead wall generally uniformly over two broad areas which generally coincide with the joist channels 75, 77, etc. Water supply line 60 and tee's 61** can be formed of any material suitable for use including but not limited to copper, steel or B.F. Goodrich BLAZEMASTER brand CPVC.

Preferably, each of the sprinklers 10, 10' and 10" is configured to discharge water from the sprinkler outwardly in each of the two distinct and different directions (44', 46') a distance B that is greater than the spread C of the water in a horizontal direction perpendicular to each of the directions 44' and 46'. In other words, the discharge from each nozzle 44 and 46 is typically like that of an individual sidewall sprinkler in that it is generally rectangular or elliptical and extends in a direction outwardly from the sprinkler a distance B which is greater than the distance C which the discharge spreads horizontally in a direction perpendicular to the outward direction. Sprinklers 10 are configured to direct water at least 10 feet, desirably more than 20 feet and preferably at least 30 feet outwardly from the sprinkler 10 in each of the two distinct directions 44' and 46' and to limit the spread of the spray in a transverse direction to less than 14 feet, desirably less than 10 feet and preferably only about 6 feet. An approximately 6'×30' effective coverage or protection area from each nozzle 44, 46 is most preferred.

In addition, sprinklers 10 preferably would be designed for optimum operation over certain ranges of pitches, for example 4/12 to 6/12, 7/12 to 9/12 and 10/12 to 12/12, by varying the angles A. The pitch from the vertical of the centerlines of the nozzles of the sprinklers of the present invention are envisioned to be within about 25° of the pitches from the vertical of the overhead wall(s) under which such sprinklers are installed.

Installed in this fashion, each bidirectional sprinkler 10 could provide the coverage of at least three standard ceiling sprinklers (having 15 foot×15 foot coverage areas), if the conventional sprinklers were centered in each successive joist channel. If standard extended coverage ceiling sprinklers could be used and spaced up to 20 feet apart, as would be permitted under NFPA 13 beneath flat roofs and ceilings, equal numbers of such ceiling sprinklers might provide protection areas equal to that provided by the same number of paired sidewall sprinklers. However, the paired sidewall sprinklers would provide better protection as each would be centered with respect to opposing joist channels 75/77 or other courses and would not be shadowed from the decking 70 by the joists 74/76, etc., as would the case with conventional sprinklers. Moreover, discharge from each of the sprinklers of the present invention would be directed downwardly roughly paralleling the pitch of the roof to cover the entire width and height of the channels for some distance along the channels, as well as the floor areas beneath the joist channels. Unlike ordinary ceiling sprinklers, paired sidewall sprinklers of the present invention do not permit heated air to travel unopposed up those joist channels to the peak of the roof. It will be appreciated that sprinklers of the present invention can be used between pairs of other adjoining, sloping overhead wall courses formed by such things as roof trusses, exposed beams on cathedral ceiling, channels defined between soffits or between soffits and vertical walls, etc.

Figure 4:
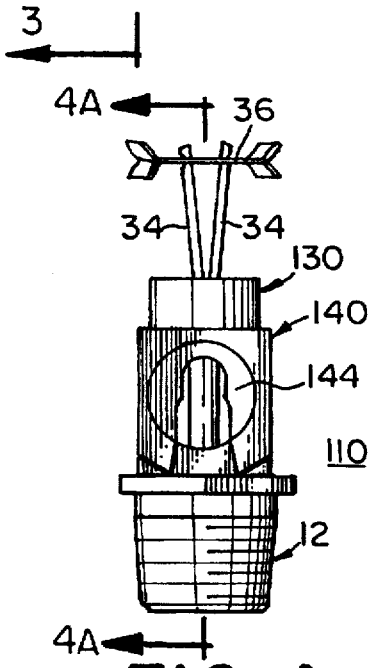
FIG. 4 is a side elevational view of a second embodiment bidirectional sprinkler.
Figure 4A:
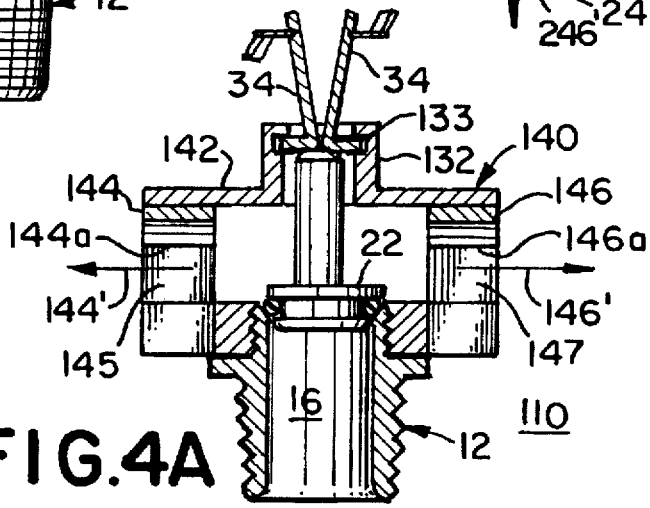
FIG. 4*a* is an elevational view of the sprinkler of FIG. 4 sectioned, but for the plug assembly, along the lines 4A—4A of FIG. 4.

FIG. 4 depicts a second embodiment bidirectional sprinkler of the present invention indicated generally at 110. The sprinkler 110 again includes the same sprinkler body 12, a modified water directing structure 140 and a modified temperature responsive trigger 130. As is best seen in FIG. 4*a*, an elevational cross-section of the sprinkler 110, a head 142 symmetrically receives a pair of substantially identical nozzles 144, 146, each with a partially enclosed water directing passage 145, 147 defining at least parts of a pair of separate water directing channels. Bores in the head 142 receiving proximal ends of the nozzles define enclosed portions of such channels. Each has a downwardly facing, water directing surface 145*a*, 146*a* having a tangentially projecting centerline 145', 147', which extends generally perpendicularly outwardly from the central axis 20 of the sprinkler body outlet 16. The centerlines 145' and 147' and the directions 144', 146' in which water is discharged by the nozzles 144 and 146 might be slightly elevated from the horizontal, for example about 80° to 85° down from the upward direction of discharge 21 from the outlet 16, to assure a distribution of water above the sprinkler 110 and against or just under the ceiling over a significant area extending away from the sprinkler 110. Preferably, a circular opening 132 and recessed groove 133 are machined into the head 142 for trigger 130, illustrating one alternate method of construction. The nozzles 144, 146 could similarly be machined into the head 142. Levers 34 and element 36 remain the same. Sprinkler 110 is intended for use beneath ceilings over relatively long and narrow areas, such as corridors, with at least the previously indicated distributions.

Figure 7:
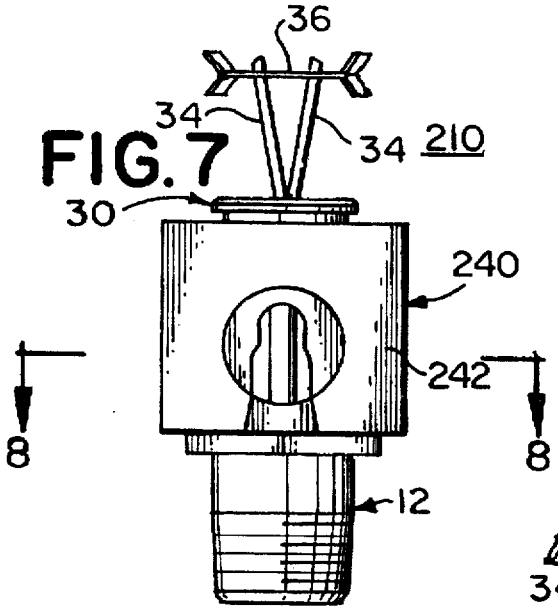
FIG. 7 is a side elevational view of a third embodiment bidirectional sprinkler.
Figure 8:
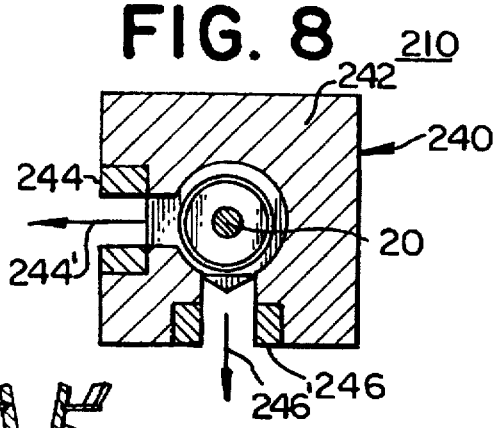
FIG. 8 is a sectioned elevational plan view taken along the lines 8—8 of FIG. 7.

FIGS. 7 and 8 depict yet a third bidirectional sprinkler embodiment of the present invention indicated generally 210. Again, sprinkler 210 includes a sprinkler body 12 previously described, a modified water directing structure 240 and a trigger 30 identical to the trigger 30 of the FIG. 1 embodiment 10. As is best seen in FIG. 8, the water directing structure 240 preferably includes a head 242 which symmetrically mounts a pair of identical nozzles 244, 246 (like nozzles 144, 146 of FIGS. 4, 4*a*), only the bottom portions of which are visible in FIG. 8, which direct water outwardly in two distinct and different directions indicated by arrowed lines 244' and 246', which are generally perpendicular to one another and at least roughly perpendicular to central axis 20 of the sprinkler body outlet 16 (e.g. between about 80° and 100° from the vertical). The paired sidewall sprinkler embodiment 210 is preferably designed for installation below the ceiling at the center of a pair of perpendicularly intersecting corridors.

Figure 9:
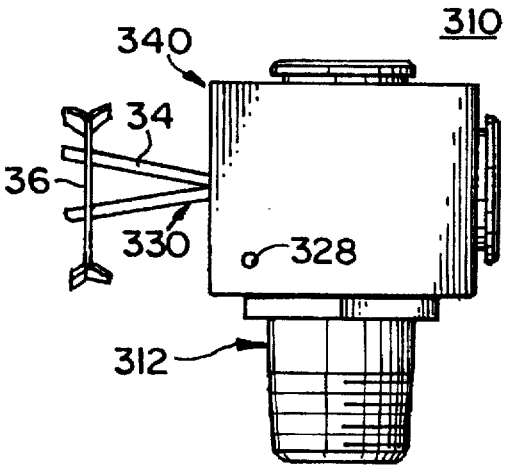
FIG. 9 is a side elevational view of a fourth embodiment bidirectional sprinkler.
Figure 10:
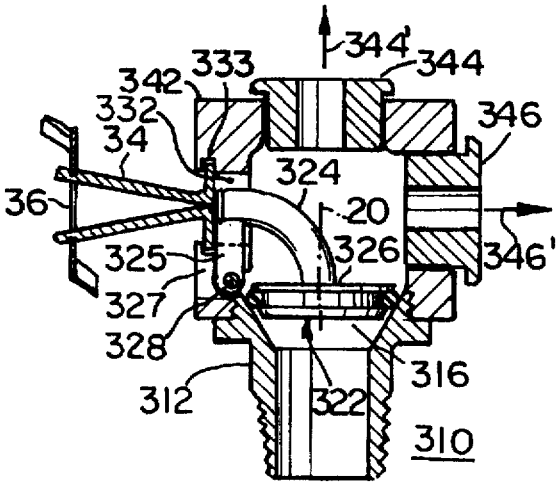
FIG. 10 is an elevational view of the sprinkler of FIG. 9 sectioned, but for the plug assembly, in the plane of FIG. 9.

FIGS. 9 and 10 depict diagrammatically a fourth bidirectional embodiment of the present invention indicated generally at 310. Sprinkler 310 includes a hollow sprinkler body 312, a modified water directing structure 340 and a slightly modified trigger 330. As is best seen in FIG. 10, nozzles 344 and 346 are assymetrically mounted with respect to body 312 and mutually perpendicularly to one another in head 342 of the water directing structure 340 with the centerline 346' of nozzle 346 being parallel and at least roughly coincident with the central axis 20 of the outlet 316 of the sprinkler body 312. Plug assembly 322 includes an addition to plug 326, a curved pin 324. A pivot arm 325 is secured at one end to the distal end of pin 324 and is pivotally coupled at its remaining end by suitable means such as pin 328 extending into or through head 342. The distal end of pin 324 and arm 325 extend into an opening 332 formed into one side of the head 342. An inner annular groove 333 is provided in the opening 332 to receive the shorter arm portions of the levers 34. Opening 332 is circularly symmetric except for a narrow, radial slot 327, which receives and permits pivotal movement of arm 325. When trigger assembly 330 is activated and levers 34 released, water pressure in the hollow body 312 forces plug 326 from the outlet 316 and causes the assembly 322 to pivot approximately 90° counterclockwise from the state indicated in FIG. 10 on arm 325 and pin 328 so that the plug 326 is moved clear of the outlet 316. Plug 326 at least substantially if not essentially seals opening 332 and slot 327, thereby causing water passing through the sprinkler body 312 to exit the head 342 through the nozzles 344 and 346, respectively. Typically, sprinkler 310 would be installed on a stem extending through a cathedral-type pitched ceiling from a supply pipe extending along one side of the peak of the ceiling, or extending up between joists supporting the ceiling, with the corner of head of 342 supporting pin 328 located most closely to the peak of the ceiling whereby the directions 344' and 346' point downwardly and outwardly along the portions of the ceiling which also pitch downwardly and outwardly from the peak of the ceiling.

Sprinklers 210 and 310 each can be installed in an upright orientation like that shown in FIGS. 7 through 10 from a water supply line running beneath a ceiling or inverted from the orientation shown in FIGS. 7 through 10 and suspended from a supply line hidden above a ceiling on a stem extended through the ceiling.

In addition to the basic embodiments disclosed, one of ordinary skill will appreciate that other embodiments could be provided, if desired. For example, a sprinkler similar to sprinkler 10 of FIGS. 1–3 might be provided by moving one of the two nozzles 44 and 46 ninety degrees around central axis 20 whereby the two nozzles would be generally perpendicular to one another in the horizontal plane. Such a sprinkler might be used, for example, beneath the downwardly and outwardly projecting peaks of a hipped roof to project water generally downwardly and outwardly at roughly right angles along opposing joint channels which extend beneath such roofs and which intersect one another at roughly right angles.

Figure 11:
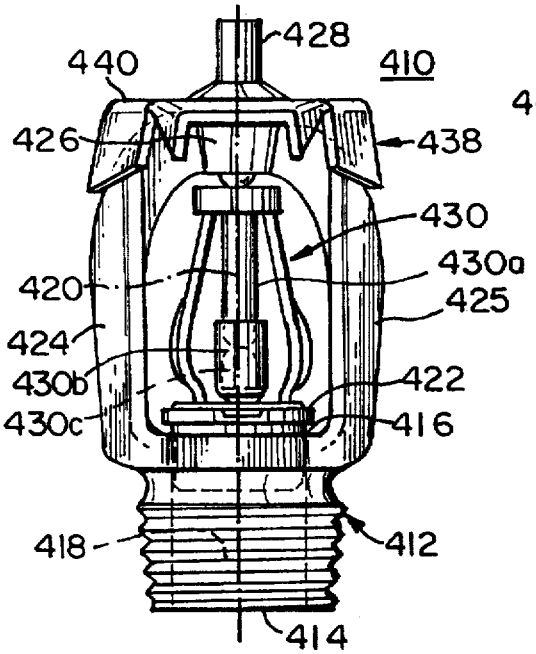
FIGS. 11 and 12 depict in orthogonal side elevational views, a fifth embodiment bidirectional sprinkler.
Figure 12:
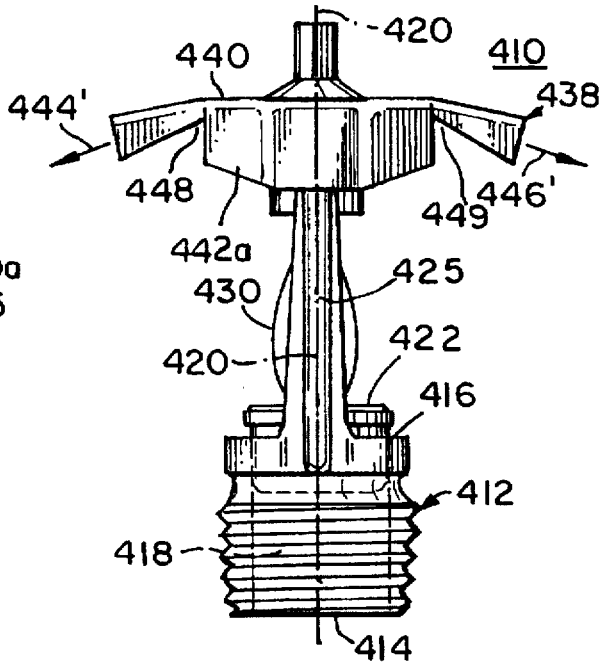
Figure 13:
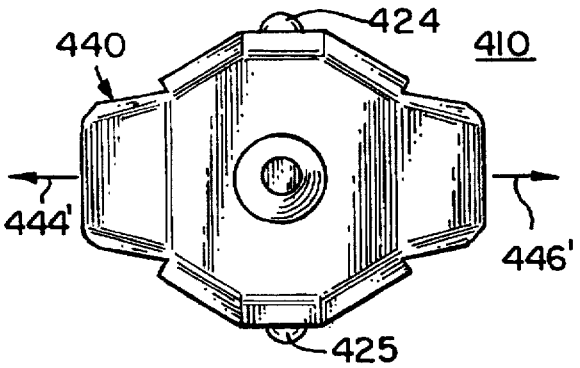
FIG. 13 is a top plan view of the sprinkler of FIGS. 11 and 12.

FIGS. 11 through 13 depict in orthogonal side elevations and top plan views, a fifth embodiment bidirectional sprinkler of the present invention indicated generally at 410. Unlike the first four embodiments, embodiment 410 is based on a conventional frame type sprinkler that employs an open, shaped plate deflector rather than an enclosed head. Sprinkler 410 includes a tubular body indicated generally at 412 having an inlet 414, an opposing outlet indicated generally at 416 and a waterway indicated in phantom at 418 coupling the inlet and the outlet. A plug 422 is releasably received in the outlet 416 at least essentially closing the outlet 416. The plug 422 is releasably retained in the outlet 416 by a temperature responsive trigger indicated generally at 430. A water directing structure, indicated generally at 438, includes a specially configured deflector 440 coupled to the sprinkler body 412 by frame arms 424, 425, which extend integrally away from the tubular body portion 412 of the sprinkler and converge at a knuckle 426. The deflector 440 is coupled with the frame in any suitable manner, for example by being swaged onto the exposed end of knuckle 426 or having the end of the knuckle spun over the deflector. Threaded adjustment element 428 is passed through a threaded bore in the knuckle 426, in a conventional fashion, to preload the temperature responsive trigger 430 against the plug 422. Trigger 430 is of a conventional type including a pair of telescoping members **430*a*, 430*b*, which are maintained in a predetermined spacing by a frangible metal alloy plug 430*c* (in phantom) held in position in the cup-like member 430*b*. Alternatively, an alcohol filled glass bulb, solder held links or other temperature responsive sprinkler trigger might be employed to releasably retain the plug 422** before activation of the sprinkler.

Figure 14:
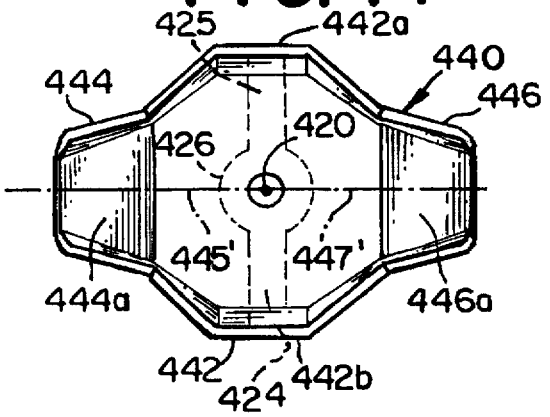
FIG. 14 is a bottom plan view of a deflector of the sprinkler of FIGS. 11–13.
Figure 15:
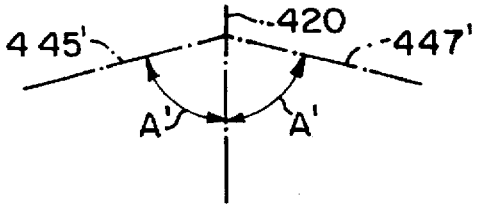
FIG. 15 depicts diagrammatically angles of intersection of tangential projections of the water directing channel surfaces of the deflector of FIG. 14.

Deflector 440 is a preferably cut and shaped piece of metal plate stock, symmetric with respect to its longitudinal and transverse central axes and positioned directly opposite the outlet 416. The knuckle 426, adjustment element 428 and adjoining portions of the arms 424 and 425 also form part of the water directing structure. They are positioned in the middle of the water column and divide the column into two substantially equal parts which flow onto the central portion 442 of the deflector. The ends of the knuckle 426 and adjustment element 416 facing the outlet 416 are generally blunt to direct water striking them down and out into the deflector on either side of frame arms 424, 425. The deflector 440 further defines two distinct and separate, diametrically opposed, water directing channels indicated at 444 and 446, which are configured and positioned to direct water outwardly from the sprinkler 410 in at least two distinct and different directions indicated generally by lined arrows 444' and 446'. Each of the two open channels 444 and 446 has a downwardly facing, preferably essentially flat water directing surface **444*a* and 446*a*, respectively, seen in FIG. 14. Centerlines 445' and 447' tangentially projecting from the extreme or distal ends of each of those surfaces 444*a*, 446*a* intersect a central axis 420 of the outlet 416 at an acute angle A' facing the orifice, which is greater than 45° and less than 90°. Angle A' is preferably about 87° (i.e. 3° down from horizontal) for use with a roof having a pitch of from about 4:12 to less than 7:12. Angle A' is preferably about 75° (i.e. 15° down from horizontal) for use with pitches of 7:12 to less than 10:12. Angle A' is preferably about 62° (i.e. 28° down from horizontal) for pitches of 10:12 to about 12:12. Sidewalls 442*a*, 442*b*, which partially surround central portion 442, extend downwardly sufficiently to essentially define with central portion 442, knuckle 426 and the ends of arms 424, 425, a pair of chambers opposite the outlet 416. Channels 444 and 446 define outlets of those chambers. Sidewalls 442*a*, 442*b* flare outwardly as they descend. The flare is less than 45° from the vertical, desirably less than 30° and preferably only about 12°. The sidewalls 442*a*, 442*b* descend and flare sufficiently to maintain pressure in the central region 442 and to direct some of the water straight down beneath the sprinkler in a relatively narrow, elongated band preferably between about six to eight feet in width. At the same time, the sidewalls are turned inwardly at their ends proximal channels 444, 446 to direct substantially all of the remaining discharged water towards the channels 444 and 446. Sidewalls of each channel, adjoining downward facing walls 444*a*, 446*a*, also flare outwardly in a downward direction but, at the same time taper inwardly with walls 444*a*, 446*a* and grow in height as they extend longitudinally away from the outlet central axis to maintain a well defined narrow distribution width over the length of the outward water throw. Cutouts 448, 449 are provided between the sidewalls 442*a*, 442*b* of the central portion and the sidewalls of each channel 444, 446 to provide a distribution of water between the water being directed downward by central portion 442 and its sidewalls 442*a*, 442*b* and the water being thrown outward by channels 444, 446. Cutouts 448, 449** are sized and shaped to further maintain the preferred substantially uniform width of between about 6 and 8 feet over the entire distribution area.

By way of example, deflector 440 might be about 2.3 inches in length and about 1.25 inches in width at its widest point at the base of sidewalls **442*a*, 442*b*. Each of the three linear wall portions of each sidewall 442*a* and 442*b* may be about one-half inch long and deflect outwardly from the top wall at an angle of about 12°. Each of the outer linear wall portions of each sidewall 442*a*, 442*b*, closest each channel 444, 446 may rise at an angle of about 20° with respect to the lowermost side of the center linear wall portion as each outermost wall portion extends to one of the channels 444, 446. Each flat water directing surface 444*a*, 446*b*, might be about 0.8 inches wide at its widest point and about 0.6 inches wide at its narrowest point. Each of the vertical wall flanking each of the surfaces 444*a*, 444*b*, may also flare outwardly at a 12° angle and have a lowermost edge descending away from the surface 444*a*, 446*a*, at an angle of about 16° as it extends in a longitudinal direction to a maximum height of about one-quarter inch from each surface 444*a*, 446*a* at the extreme distal end of each channel 444, 446. The descending sidewall of the deflector 440 is approximately 0.0025 of an inch high at the deepest part of each cut-out 448, 449. The frame arms 424, 425 and knuckle 426 support the deflector 440 approximately 1.4 to 1.5 inches from tubular body orifice near the outlet end 416 of the tubular body 412**.

Arms 424, 425, knuckle 426 and adjustment element 428 are positioned sufficiently symmetrically and coaxially with respect to the central axis 420 of the outlet 416 and thus the center of the water column issuing from outlet 416 so as to divide that column into two substantially equal parts and to direct the parts with central portion 442 primarily outwardly along each of the channels 444, 446 in the directions 444', 446' to distribute water over two areas, each extending outwardly away from the sprinkler 410 in each of the directions 444', 446' a distance greater than a distance each area extends in a direction horizontally perpendicular to each of those two directions 444', 446'.

It is suggested that the sprinkler body 412 be of a larger size than the standard one-half inch (12.7 mm) diameter orifice with a K factor greater than 6, preferably a 17/32 inch (13.5 mm) diameter orifice having a K factor of about 7.8 or more in order that the minimum required pressure of the sprinkler is kept below 40 psi and preferably below about 30 psi to eliminate the need for the provision of a pressure boosting pump. A sprinkler similar to that depicted in FIGS. 11–14 with a 17/32 diameter orifice and nominal 7.8K factor has been rated by UL to protect up to 400 square feet of area beneath the sprinkler with a span of up to 60 feet (30 feet in each opposing direction of discharge).

Figure 16:
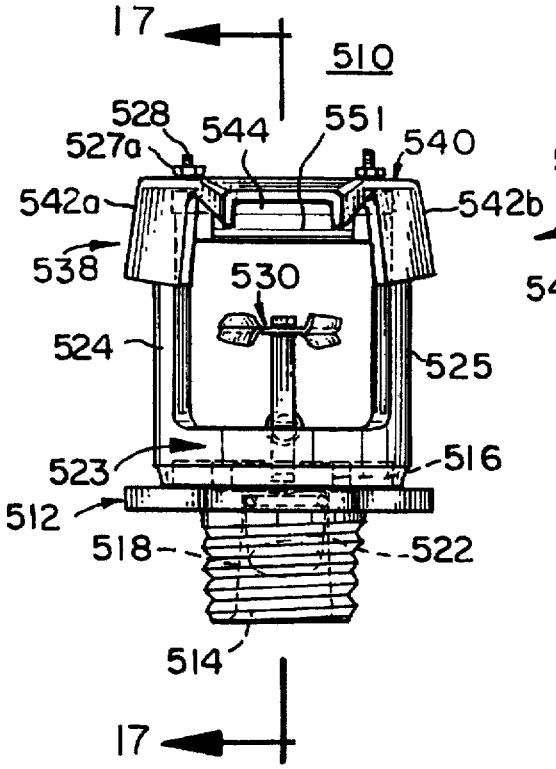
FIG. 16 is a side elevational view of a sixth embodiment bidirectional sprinkler.
Figure 17:
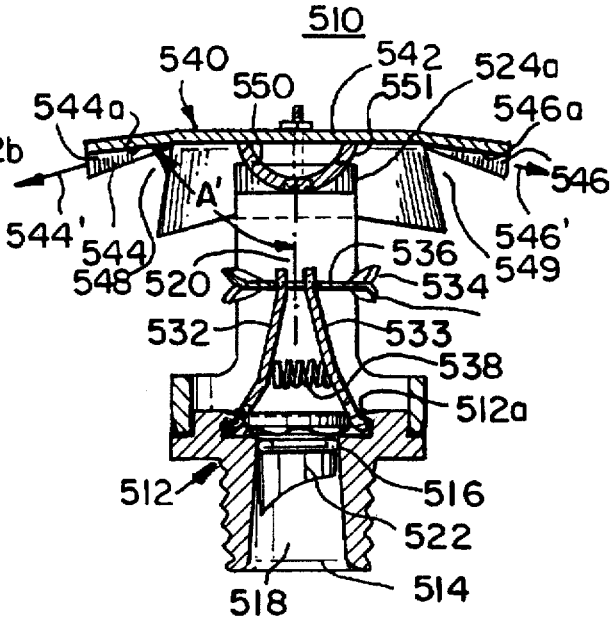
FIG. 17 is a side elevational view of the sprinkler of FIG. 16, sectioned, but for the plug assembly, along the lines 17—17 of FIG. 16.
Figure 18:
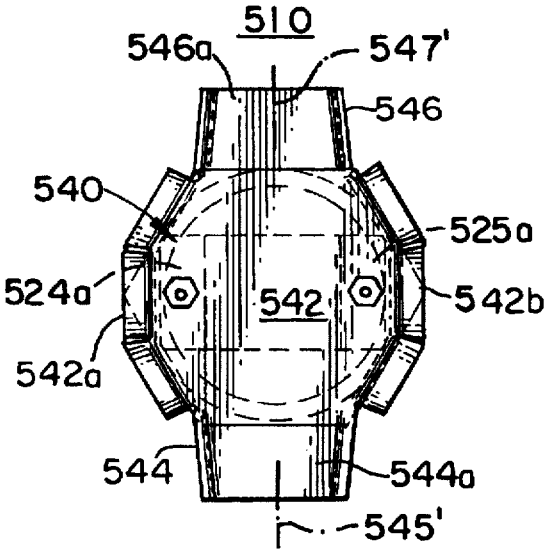
FIG. 18 is a top plan view of the sprinkler of FIG. 16.

FIGS. 16–18 depict a sixth embodiment bidirectional sprinkler of the present invention indicated generally at 510. Like the fifth embodiment sprinkler 410 of FIGS. 11–13, the sixth embodiment sprinkler 510 employs an open deflector rather than an enclosed head in the water deflecting structure. Sprinkler 510 includes a tubular body indicated generally at 512 having an inlet 514, an opposing outlet 516 and a waterway indicated in phantom at 518 coupling the inlet and the outlet. A plug 522 is releasably received in the outlet 516 closing the outlet 516. Plug 522 is releasably retained in the outlet 516 by a temperature responsive trigger indicated generally at 530. A water directing structure indicated generally at 538 is coupled to the sprinkler body 512 by arms 524, 525, which are formed in one piece with and extend integrally away from a cylindrical collar 523. Collar 523 is secured to the body portion 512 proximal the outlet 516 in any desired way, for example by swaging or spinning onto the body. Alternatively, the arms can be formed in one piece with the body or joined directly to the body without a collar, if desired.

The water directing structure 538 preferably includes a deflector indicated generally at 540 and formed from a cut and shaped piece of metal plate stock. The water directing structure 538 further includes a semi-cylindrical curved surface 551 defined by a semi-cylindrical member 550 positioned between deflector 540 and the outlet 516. In the preferred embodiment, deflector 540 is identical to deflector 440. Member 550 could be replaced by a suitable curvature in the center of the deflector 540 or by a suitable bridge portion extending between the ends of arms 524, 525 and providing such a curved surface 551. Preferably, the deflector 540 and member 550 are coupled by suitable means such as nut and bolt connectors **527*a*, 527*b* respectively or rivets (not depicted) to the extreme distal ends of the arms 524, 525, which have been inwardly turned towards one another forming flanges 524*a*, 525*a*. The semi-cylindrical member 550 is positioned extending longitudinally between the free or distal ends 524*a*, 524*b* of arms 524, 525 and, at its center is spaced between about 1.1 and 1.2 inches from the tubular body orifice near the outlet of the tubular body. A temperature-responsive trigger is indicated generally at 530 and releasably retains plug 522 in the outlet 516. The trigger 530 includes a pair of lever arms 532, 533, "free" ends of which are held together by a pair of the solder joined identical links 38, 38', which are shown in greater detail in FIGS. 19 and 19A with solder layer 39. Remaining ends of the levers 532, 533 bear against the exposed upper surface of plug 522, which may be slotted to help locate the levers, and project under and engage a circumferential groove 512*a* in the body 512 at the outlet 516. A spring 538 may be provided to bias the "free" ends of the lever arms 532, 533 apart, keeping them engaged with the links 38, 38'. The links 38, 38' are held together by the solder layer 39 until the solder is heated to a predetermined elevated temperature above room temperature at which point it softens sufficiently to release the links from one another, thereby permitting the levers 532, 533 to pivot apart and away from beneath groove 512*a* and release the plug 522**.

Deflector 540 includes a central portion 542 receiving the cylindrical member 550 and the ends of arms 524, 525, and two distinct and separate, diametrically opposed, water directing channels, which are indicated generally at 544 and 546, respectively. Channels 544, 546 adjoin ends of the central portion 542 and are configured and positioned to direct water outwardly from the sprinkler 510 in at least two distinct and different (e.g. opposing) directions, indicated generally by lined arrows 544' and 546'. Each of the two open channels 544, 546 has a downwardly facing, preferably essentially flat water directing surface **544*a*, 546*a*, respectively, best seen in FIG. 17. Centerlines 545', 547' tangentially project from the extreme free or distal ends of each of those surfaces 544*a*, 546*a*, respectfully, back to intersect a central axis 520 of the outlet 516 at an acute angle A', which is again greater than 45° and less than 90°. In this embodiment, the acute angle A' is again preferably about 87° for roof pitches of about 4:12 to less than 7:12, about 75° for roof pitches of 7:12 to less than 10:12 and about 62° for roof pitches of 10:12 and above. Cutouts 548 and 549 provide a water distribution of substantially uniform width between the water directed directly downward by surface 551, central portion 542 and its sidewalls 542*a*, 542*b* and the water being thrown outwardly by channels 544, 546. The sidewalls 544, 546 increase in height as they angle inwardly while extending towards the channels 544, 546 to maintain the width of the water being discharged in the areas immediately to either side of sprinkler 510. This change from sprinkler 410 is needed because of the presence of semicylindrical surface 551 and higher operating water pressure utilized with this sprinkler. The curved surface of member 550, which faces the outlet 516, is shaped and positioned directly opposite the outlet 516, symmetric to the central axis 520 of the outlet, to receive and substantially uniformly divide the water column issuing from the outlet 516 and to direct it primarily outwardly along each of the channels 544, 546 in the directions 544', 546' so as to distribute water over two areas. Each area extends outwardly away from the sprinkler 530 in each of the directions 544', 546' a distance greater than a distance each area extends in a direction horizontally perpendicular to each of those two directions 544', 546'. Sidewalls 542*a*, 542*b*, which partially surround the central portion 542, extend downwardly and flare outwardly sufficiently to essentially define with central portion 542 and member 550, a pair of chambers opposite the outlet 516 which substantially equally divide and direct substantially all of the water down channels 544, 546 and a remainder of the discharged water down beneath the sprinkler. Again, longitudinal ends of sidewalls 542*a*, 542*b* closest to channels 544, 546 are reduced in flaring and are longitudinally tapered towards those channels to insure that water is discharged in a relatively narrow band beneath the sprinkler connecting the two elongated areas covered by water discharged from the channels 544, 546**.

The semi-cylindrical surface of member 550 is preferred to the frame arm of sprinkler 410 to obtain a more uniform division and distribution of the water column discharging at relatively higher pressures, such occurs when a sprinkler with a smaller sized outlet is used. For example, sufficiently uniform distribution can be obtained for up to 30 feet in each direction 544', 546' with sprinklers 510 having a standard ½ inch (12.7 mm) diameter outlet with a nominal 5.6K factor, but only by using discharge pressures of about 45 to 50 psi. At pressures of about 20 psi, the outward throw from such sprinkler 510 is approximately 20 feet in each of the two opposing directions. Currently suggested spacing of sprinklers 410 and 510 from one another along the supply pipe are at least 4 feet to prevent cold solder failure and no more than 6 feet to insure adequate overlapping coverage.

Figure 20:
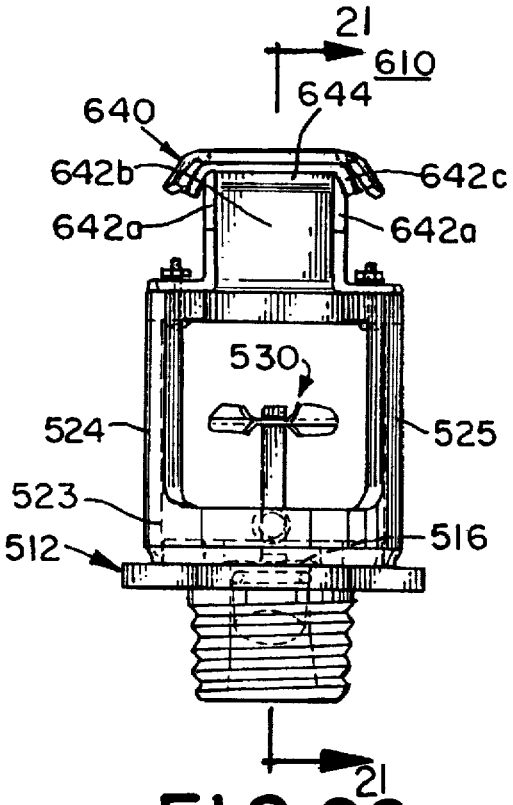
FIG. 20 is a front elevational view of a single directional sprinkler of the present invention.
Figure 21:
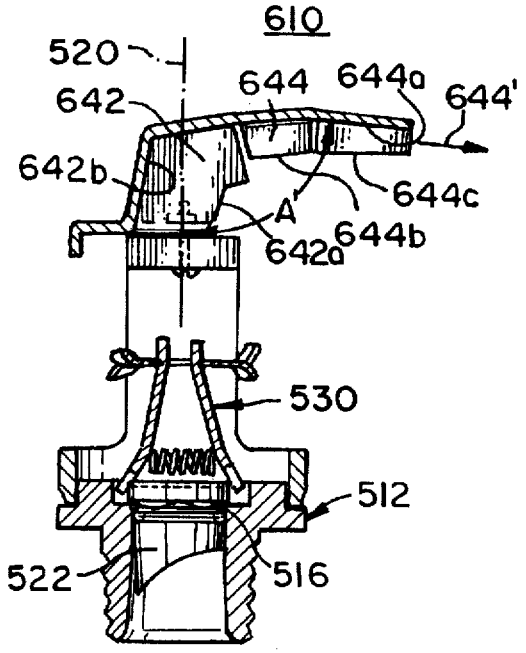
FIG. 21 is a sectioned elevational view taken along the line 21—21 in FIG. 20.
Figure 22:
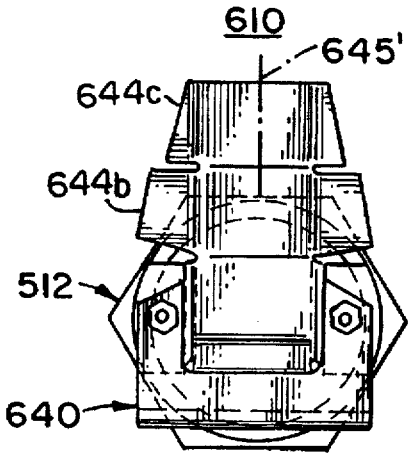
FIG. 22 is a top plan view of the sprinkler of FIGS. 20 and 21.

FIGS. 20–22 depict a single directional sidewall sprinkler of the present invention indicated generally at 610 having a tubular body 512, which is preferably identical to the body 512 described above with respect to FIGS. 16–18. Again, an identical plug 522 and temperature-responsive trigger 530 are employed releasably retaining plug 522 in the outlet 516 of the body 512. Collar 523 with arms 524 and 525 is again secured to the outlet end of the body 512 and supports a water directing structure in the form of horn-shaped deflector indicated at 640. Deflector 640 may be formed by cutting a blank 640' (FIG. 23) from suitable plate stock and bending the various tabs. Edges 630*a*/630*b* are preferably brazed together as are edges 631*a*/631*b* on either side of the blank. The deflector 640 includes a central top portion, indicated generally at 642 which, with descending mirror image sidewall portions 642*a*, and sloping rear wall 642*b*, which extends partially into the water column, define a chamber that essentially receives the entire water column discharging from the outlet 516 when the sprinkler 610 is activated. The remainder of the deflector 640 defines a water directing channel, indicated generally at 644, which is configured and positioned to direct water received from the 35 chamber outwardly from the sprinkler 610, in the direction indicated by arrow 644'. Channel 644 has a distal downwardly facing, water directing surface 644*a* and descending pairs of sidewalls 644*b* and 644*c*. The centerline of surface 644*a* is indicated at 645'. When projected tangentially from the remote end of that surface back to the central axis 520 of the outlet 516, centerline 645' intersects axis 520 at the acute angle A', which is greater than 45° and less than 90° and preferably about 87°, 75° or 62° depending upon the pitch of the roof as with the prior deflectors 440 and 540. The central portion 642 and rear wall 642*b* are wider than the width of the water column. Rear wall 642*b* suggestedly intersects between about one-half and three-quarters of the water column. Sidewalls 644*b* and 644*c* flare outwardly from the vertical at less than 60° and preferably at about 40° and 22°, respectively, to maintain a substantially uniform width to the water being discharged from the deflector 640 over the entire length of the discharge area.

Figure 23:
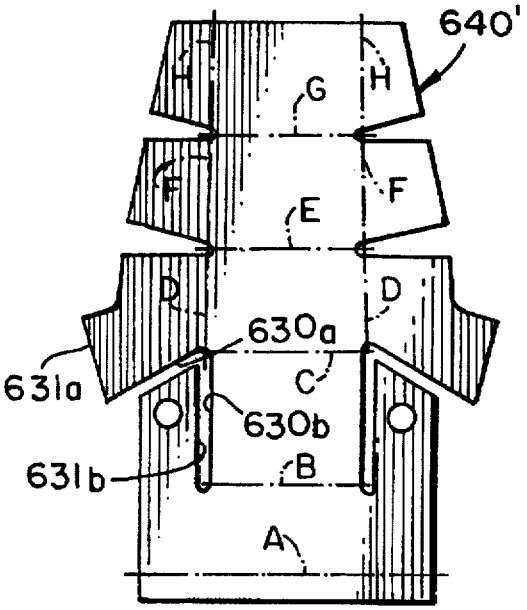
FIG. 23 is a plan view of the stamped blank used to fabricate the deflector of the single directional sprinkler embodiment of FIGS. 20–22.

FIG. 23 depicting blank 640' shows various bend lines A–H for a preferred embodiment deflector 640. The preferred bends are, for a deflector used with roof pitches of 4:12 to less than 7:12: A- of 90°; B- down 78°; C- of 61°; D- up 90°; E- up 11°; F- up 50°; G- up 9°; and H- up 68°. For pitches of about 7:12 to less than 10:12, angle G is up 21°. For pitches of about 10:12 to about 12:12, angle G is up 34°. These provide net downward deflections of about 3°, 15° and 28°, respectively, at the extreme distal end of water directing surface 644*a* from a plane perpendicular to the central axis 520 of tubular body 512 and its outlet 516 and plug 522. The length of the blank 640' before bending is slightly less than 2.5 inches and its width, at its widest point, approximately 1.7 inches. The distance between bends B and C is slightly more than one-half inch. The distance between bends C and E, E and G and the length of the deflector from G to the distal end is each slightly less than one-half inch. The base of the deflector located between bends B and C, is supported on the arms 524, 525 about 1.5 inches from the tubular body orifice near the outlet end 516 of the tubular body 512.

Body 512 preferably has a standard ½ inch (12.7 mm) diameter orifice with a nominal 5.6K factor, which provides with deflector 640 a throw of up to 40 feet outwardly from the deflector horn 645' at a water pressure of only about 39 psi. A pressure of about 11.5 psi provides a throw of about 10 feet. This sprinkler is designed particularly for use with hip roofs and dormers.

Figure 24:
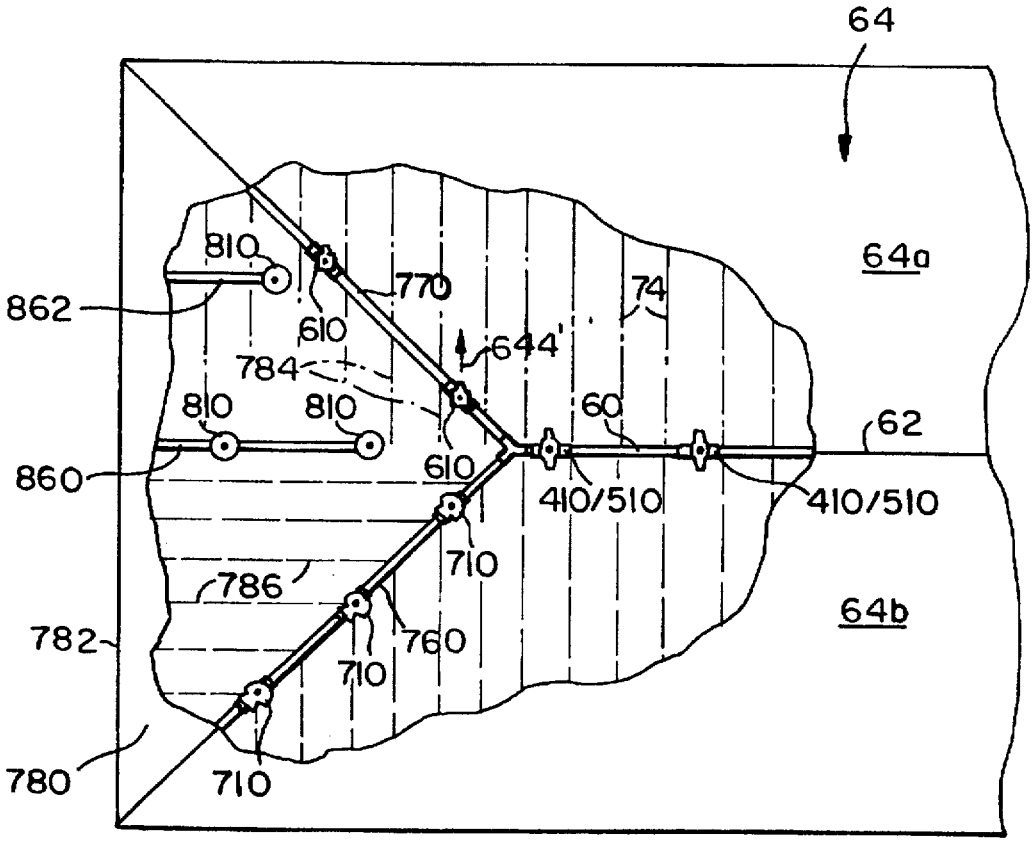
FIG. 24 is a schematic, partially broken away top plan view of a hipped roof.
Figure 25:
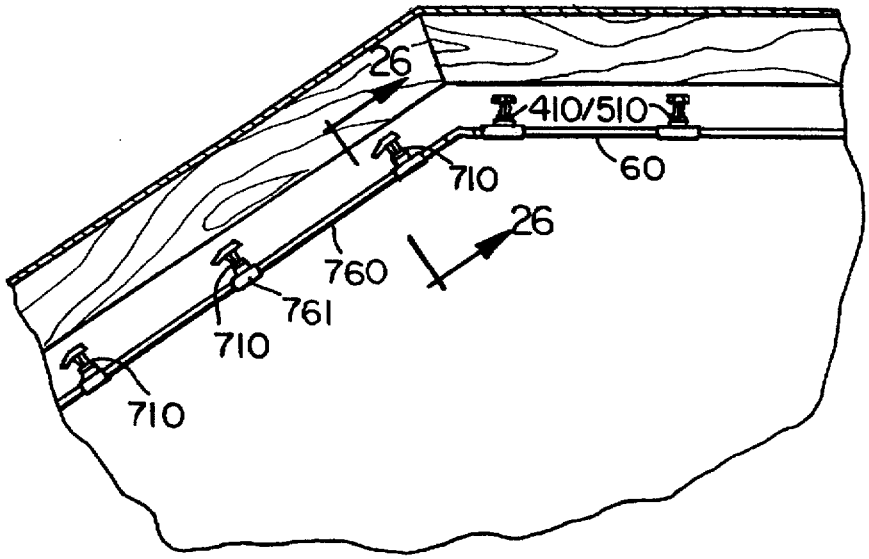
FIG. 25 is a schematic, broken away side elevational view of a portion of the roof of FIG. 24.

FIG. 24 is a schematic top plan view of a hip roof 64, which is partially broken away to show branch water supply lines 760 and 770. Each extends down one of the two ridges defining a hip provided at one end of the main pitched roof 64 by a third pitched roof portion 780 and may be considered part of or an extension of the straight conduit defining line 60 beneath peak 62. Portion 780 adjoins one end of each of the two portions 64*a*, 64*b*, which are typically symmetrically pitched with respect to the vertical and which define the peak 62 of the main roof 64 at their intersection. As indicated in FIG. 25, branch water supply line 760 might extend from one end of the primary water supply line 60 (see FIGS. 5 and 6), which itself extends horizontally beneath the peak 62 of the main portion of the roof 64. Line 770 might be similarly installed.

Main roof joists 74 are indicated in phantom. FIG. 24 is schematic in that the joists in the hip region of the roof are shown extending simultaneously in different directions to illustrate two common methods of hip roof construction: (1) joists 784 (in phantom) running parallel to the joists 74 in the main portion of the roof and parallel to the outside wall 782, and (2) joists 786 (in phantom) running perpendicular to the joists 74 in the main portion of the roof 64 and to the outside wall 782.

It is suggest that where joists 784 in the hip run parallel to the main roof joists 74, that unidirectional sprinklers 610 be installed with the direction of discharge 644' of each pointed perpendicularly away from the peak 62, and parallel to the joists 74. The area beneath pitched portion 780 is protected by conventional sprinklers 810, having a symmetric discharge, which are mounted to one or more branch water supply lines 860, 862.

In those areas of a hip roof where the joists or other support members extend away from a peak of the roof in directions perpendicular to one another, like joists 74 and 786, it is suggested that a modified bidirectional sprinkler 710 be employed. Mounted on branch supply line 760 via conventional tee's 761 are a plurality of such bidirectional sprinklers 710, which are designed particularly for installation in such roof hip areas and which are described in greater detail with respect to FIGS. 26–28.

Figure 26:
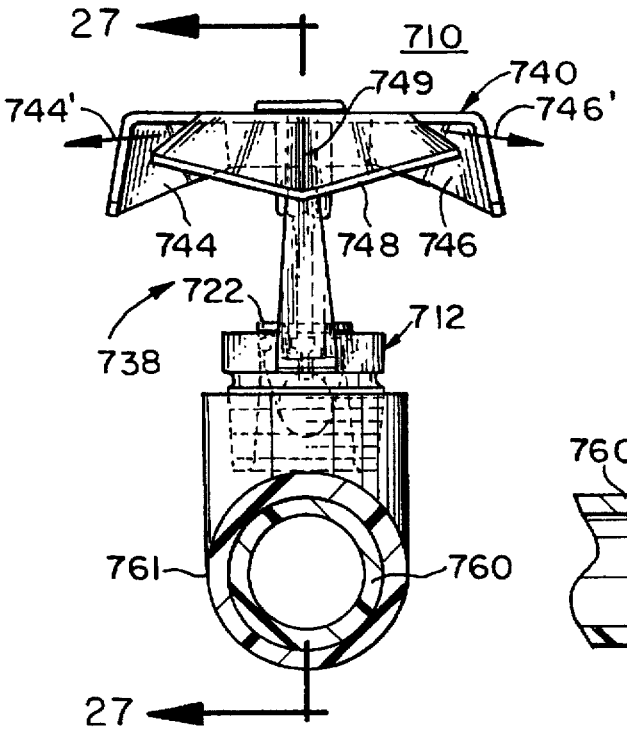
FIG. 26 is a front elevational view taken along the lines 26—26 of FIG. 25 showing a sectioned branch line and a seventh embodiment bidirectional sprinkler designed for use specifically beneath a hipped roof.
Figure 27:
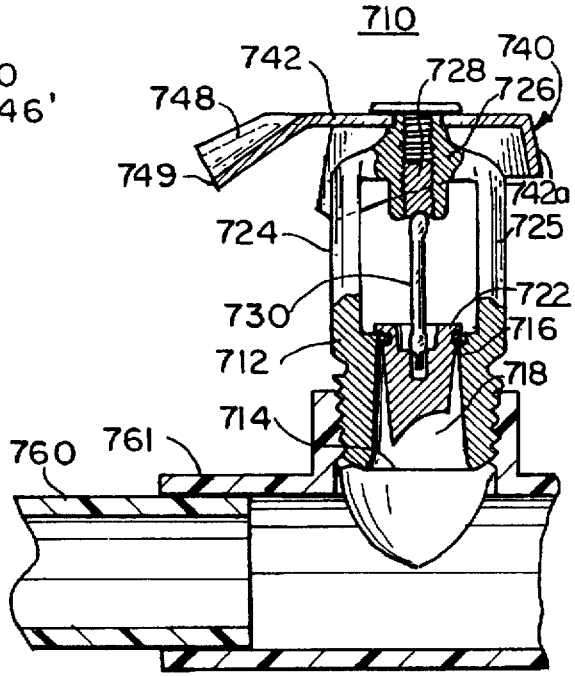
FIG. 27 is a side elevational view of the sprinkler and branch line of FIG. 26 taken along the lines 27—27 of FIG. 26.
Figure 28:
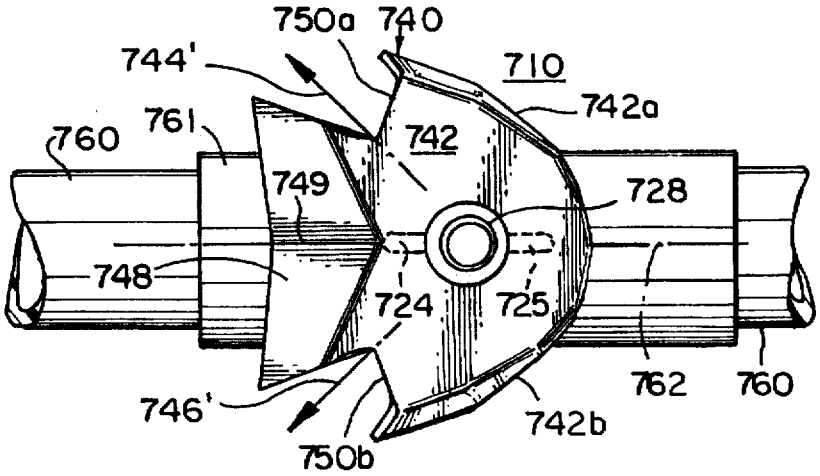
FIG. 28 is a top plan view of the bidirectional sprinkler of FIGS. 26 and 27.

Each sprinkler 710 has a sprinkler body 712 which can be identical or at least essentially similar to body 412, including an inlet 714, an outlet 716 and a waterway 718 coupling the inlet and the outlet. The outlet 716 receives a plug valve 722, which is releasably retained by a temperature responsive trigger, for example, an alcohol filled frangible glass bulb 730. A water directing structure indicated generally at 738 includes frame arms 724 and 725 and a connecting knuckle 726. The knuckle 726 includes a threaded bore receiving a set screw 728 or other threaded member 728 used to adjust the compression on bulb 730. The water directing structure 738 further includes an open deflector 740, which is swaged or spun or mounted by other suitable means to the distal end of the knuckle 728. The deflector 740 is symmetric with respect to a central longitudinal plane and is mounted with the plane extending through a longitudinal center line 762 of the supply line 760 on which the sprinkler 710 is mounted. The central plane bisects each of the arms 724, 725 and the knuckle 726 of the frame. The deflector 740 includes a planar central area 742, which is curvilinear as shown over an arc of about 140° and which supports a descending sidewall 742*a*, which flares outwardly at about a 10° angle as it descends from the planar central area 742. The width of the planar area 742 varies from about 1.15 to 1.85 inches at the cut-outs. A tongue portion 748 extends longitudinally outwardly and downwardly from the central planar area 742 opposite sidewall 742*a* and includes a central downward fold 749 about three-quarters of an inch long, which is preferably coincident with the central plane of the sprinkler and longitudinal center line 762 in the figure and at about a 40° angle to the planar central area 742. The fold forms an acute angle of about 155° in the tongue. The lower side of the central area 742*a* facing the outlet end of the tubular body is supported about one and one-quarter inches from the orifice of the tubular body. Tongue 748 and the frame formed by arms 724, 725, knuckle 726 and screw 728 effectively define with center portion 742, two adjoining chambers, which receive and substantially evenly divide the water discharged from the outlet 716. Approximately right angle notches 750*a* and 750*b* are located at approximately 90° positions from the center of the sprinkler body 712, which is represented in FIG. 28 by the center of adjustment screw 728. Flat central portion 742 and descending sidewall 742*a* receive the water column split by the frame and retain it until it escapes forwardly through channels 744 and 746 (FIG. 26). Channels 744 and 746 are centered on the notches 750*a* and 750*b*, respectively, and are defined by those notches and by edges of the sidewall 742*a* and tongue portion 748 descending from either side of each notch. The sidewall 742*a* extends downwardly and flares outwardly from the vertical as it descends from the planar central portion 742 so as to better retain water being discharged through the outlet 716 until substantially all of that water has had an opportunity to move forwardly through the channels 744, 746. It further discharges any remaining water downwardly and outwardly beneath the sprinkler 710 and provides overlapping coverage below the next downwardly located sprinkler 710. The tongue member 748 intercepts the forward moving water and directs it downwardly and outwardly away from the longitudinal center line 762 achieving flows in two different directions indicated by lined arrows 744' and 746', which are approximately 90° to one another. Tongue member 748 further shields from the discharge any sprinkler directly in front of sprinkler 710. With a body 712 having a standard ½ inch (12.7 mm) diameter orifice and nominal 5.6K factor, water can be effectively discharged for fire protection up to 28 feet outwardly in either of the two directions 744', 746' with a water pressure of less than 40 psi. Effective distribution for up to 20 feet in either direction can be achieved with water pressures of only 20 psi. Three to six feet spacing is suggested between sprinklers 710 mounted consecutively on the same supply line 760 and the highest sprinkler 710 (located closest to the main peak 62) should be located no more than three feet down the slope from the main peak.

Sprinklers 710 are installed in a hip roof where the joists in the hip extend at right angles to one another from the peak of the hip. Sprinkler 710 discharges in two directions at right angles to each other and parallel to the courses defined by the joists 74 and 786, as indicated in FIG. 24.

All previously indicated water distributions are for light hazard and provide at least about 0.1 gallons per minute or more, on average, over the area protected by the sprinkler. Current maximum protected areas per sprinkler are 400 square feet for "back to back sidewall" bidirectional sprinklers 410 and 510. Installations of single directional sprinklers 610 and bidirectional hip roof sprinklers 710 are governed only by roof span and sprinkler spacing.

Suggested spacing of sprinklers 410 and 510 are at least 4 feet and at least 6 feet, respectively, from standard ceiling sprinklers to protect against cold solder failure and no more than 6 feet apart from one another for adequate overlapping coverage. All sprinklers should be installed within about two feet and preferably at least 16 and no more than 22 inches below the lower or inner side of the pitched roof or other pitched internal wall being protected. Maximum suggested height of the roof or ceiling being protected above the underlying floor is 40 feet. Maximum horizontal protection provided in either discharge direction of either sprinkler 410, 510 is 30 feet. The 400 square foot maximum coverage area is determined by doubling the distance of the farthest throw of either sprinkler 410, 510, measured along the slope of the wall above the throw, multiplied by the distance of one sprinkler from the farthest immediately adjoining sprinkler to either side of the one sprinkler on the same branch line. Maximum horizontal throw for the single directional sprinkler is currently fixed at 40 feet while the width of the affected protected area is about 6 feet. The maximum throw currently permitted from bidirectional hip roof sprinkler 710 is about 28 feet in each horizontal direction 744', 746'.

All sprinklers except sprinklers 310 and 710 are intended to be installed in the upright position with the outlet pointing up and the frame arms, where provided, straight up and down. When installed beneath the peak 62 of a pitched roof, the arms of sprinklers 410, 510 and 610 are oriented parallel to a vertical plane through the peak so that each sprinkler discharges away from the peak. Sprinkler 710 is installed with its deflector 740 parallel with the slope of the local roof peak beneath which it is installed.

Sprinklers of the present invention, particularly sprinklers 410, 510, 610 and 710 of FIGS. 11–14, 16–23 and 26–28, provide light hazard fire protection at least as good as that provided by standard conventional sprinklers but at a considerable savings. For example, an attic 60 feet in width can be protected by a single supply line running along the peak and equipped with sprinklers 410 or 510, unless a single directional sprinkler 610 or a bidirectional sprinkler 710 is needed in a hip area. In that case, there would still only be one line in each area. By contrast, using standard ceiling sprinklers as is current practice, at least four and typically five separate parallel branch lines, each supporting a plurality of standard sprinklers, would be required to provide the same coverage since standard sprinklers are only rated to provide up to 225 square feet (15×15 feet) of fire protection coverage. The savings in pipe and sprinklers, as well as the associated labor cost, from using the present invention are significant. Also, the pipe volume of the system is significantly reduced, which would reduce the size of a dry pipe valve where a dry system is installed.

One of ordinary skill will appreciate that a number of different manufacturing techniques can be used to fabricate sprinklers of the present invention. While the manufacture of individual sprinkler bodies, water directing heads, separate nozzles, temperature responsive triggers, etc. have been disclosed, other manufacturing techniques can be employed. For example, nozzles may be machined into the head or the head formed integrally with the remainder of the sprinkler body. Structure and location of the nozzles can be varied. While the direction of water in at least two distinct and separate directions is preferred, there may be situations in which the distribution of water in three or more separate and distinct directions is desired and which can be achieved by the expediency of adding one or more nozzles and suitably positioning such nozzles in a water directing head or suitably cutting and shaping a plate to form an open deflector of three or more channels. While the use of levers 34 and links 38, 38', telescoping members 430*a*, 430*b* and frangible bulbs 730 have been disclosed, other types of temperature responsive triggers conventionally used with sprinklers can be used or adapted for use with the water directing structure and heads of the present invention to releasably retain plugs closing the outlet orifice of the sprinkler body. These triggers might include, for example and without limitation, triggers like those shown in U.S. Pat. Nos. 4,491,182, 4,618,001, 4,630,682, 4,976,320 and 5,083,616, all without the provision of frame arms, or U.S. Pat. Nos. 4,117,887 and 5,080,176, with frame arms, all incorporated by reference herein. The sprinklers might be installed on metal or plastic supply pipe. A particularly cost effective plastic pipe installation is disclosed in U.S. application Ser. No. 08/035,856 filed Mar. 23, 1993, and incorporated by reference herein.

The downwardly facing, water directing surfaces 45*a*, 47*a*, 144*a*, 146*a*, 444*a*, 446*a*, 544*a*, 546*a*, 644*a* and 742 of the various embodiments disclosed above are preferably at least essentially planar so that the disclosed centerlines 45', 47', 445', 447', 545', 547', 645', 744' and 746' project tangentially from each point along the center of such surfaces. It will be appreciated by those skilled in the art that the downward facing, water directing surfaces of the channels need not be perfectly planar as preferred but may be curved or a combination of straight and curved surfaces. However at least essentially planar downwardly facing channel surfaces are preferred for ease of fabrication and uniform water distribution. It is also believed that it is the angular orientation of the center of the water directing surface at its point most distant or distal to the central axis of the outlet, where the surface is still actually directing water, which is most significant to the downward directing of water by the various disclosed channels and nozzles. That is, the tangential projection from water discharge point or location located farthest along the centerline of the downwardly facing, water directing surface is important to the final direction of water being discharged from the sprinkler and should be directed at an acute angle to the central axis of the outlet which is greater than 45° and less than 90°, at least for those embodiments which are being used beneath peaked overhead interior walls (i.e. roofs, cathedral ceilings, etc.). The curvature or pitch of such downward facing deflector surfaces beyond the point where water is being discharged from the deflector is believed irrelevant or at least of little consequence to the main distribution pattern of the discharged water.

Reference has been made above only to water as a fire extinguishant. However, it should be appreciated that the sprinklers of the present invention like other automatic sprinklers may be used with other fire extinguishing fluids regardless of whether such fluids are based upon water or other fluid materials. Water is being used generically to refer to all such fluid extinguishants which are or may be dischargeable by automatic fire extinguishers.

While several different preferred embodiments of the invention have been disclosed and various modifications thereto suggested, it will be recognized by those skilled in the art that changes may be made to the above-described inventions without departing from the broad inventive concepts thereof. For example, channels and nozzles of sprinklers of the present invention may be raised to provide acute angles "A" of 90° or more to the central axis of the sprinkler outlet for use beneath flat ceilings in long hallways and at the corner of hallways, for example. Also, it will be appreciated that a bidirectional sprinkler might also be fabricated from the disclosed unidirectional sprinkler 710 by symmetrically duplicating the sprinkler from the channel 644 back to the central axis of the outlet on the opposing side of the central axis of that sprinkler. A sharp boundary between the two halves will be provided to sharply divide and direct the water to each channel to be outwardly thrown. A softer, more cylindrical transition can be provided, as was provided in sprinkler 510, if a greater distribution of water directly under the sprinkler is desired. Accordingly, reference should be made to the appended claims, rather than to the embodiments of the foregoing specification, as indicating the scope of the invention.

There now follows as a part of this specification, three Underwriters Laboratories, Inc. reports: File Ex683 Project 94NK9620 Aug. 23, 1994 REPORT on SPRINKLERS, AUTOMATIC AND OPEN (VNIV) Central Sprinkler Co. Lansdale, Pa.; File Ex683 Project 94NK9620 *Project 94NK9621 Issued: Aug. 23, 1994, revised: Dec. 2, 1994 REPORTS on SPRINKLERS, AUTOMATIC AND OPEN (VNIV) Central Sprinkler Co. Lansdale, Pa.; and File Ex683 Project 94NK9621 Dec. 2, 1994 REPORT on AUTOMATIC SPRINKLERS Central Sprinkler Co. Lansdale, Pa. In the reports, the sprinkler 410 of FIGS. 11–14 is referred to as BB-1, BB-2 or BB-3 having a nominal orifice diameter of 17/32 in. (K factor equals 7.8). It is also sometimes referred to as BB1-17/32, BB2-17/32 and BB3-17/32. The "1", "2" and "3" designations in the first report relate to deflectors having the preferred indicated acute angles A' of about 3°, 15° and 28° from a plane perpendicular to the central axis of the tubular body of the sprinkler and its orifice and outlet end for use beneath overhead walls having pitches of from about 4:12 to less than 7:12, from 7:12 to less than 10:12 and from 10:12 to about 12:12, respectively. The same references are carried into the second report, which further refers to model HIP-1, also with a ½ in. orifice. HIP-1 is a reference to sprinkler 710 of FIGS. 26–28. The third report refers to unidirectional sprinklers models SD1 and SD2. These are the single directional sprinklers 610 of FIGS. 20–23 having channel directing surfaces 644*a* pitched downwardly about 3° and 15°, respectively, from a plane perpendicular to the central axis 520 of the tubular body 512. SD3, if used, refers to a single directional sprinkler 610 having a 28° pitched surface 644*a*. The third report also refers to directional sprinklers BB-1, BB-2 and BB-3, with nominal orifice diameters of ½ inch (K factor equals 5.7). These are references to the sprinkler 510 of FIGS. 16–18 in which water directing surfaces 544*a*, 546*a* are directed downwardly from a plane perpendicular to the central axis 520 of the tubular body 512 at angles of 3°, 15° and 28°, respectively, for use with pitches of about 4:12 to less than 7:12, from 7:12 to less than 10:12 and from 10:12 to about 12:12, respectively. Model A sprinklers run in comparison tests are Central Sprinkler Co.'s Model A SSU (Standard Spray Upright) sprinklers with one-half inch orifices.

In the water distribution tests, the indicated average discharge density is that collected in the indicated foot square collection pans. Average collected densities are more than 0.07 gallons per minute (gpm/ft.$^2$) and are at least 0.09 gpm/ft.$^2$ or more in the indicated collection areas. It is further noted that trace amounts of water (densities of less than 0.01 gpm/ft.$^2$) can be tolerated as can densities as low as 0.01 gpm/ft.$^2$. In fact, in at least some tests, up to one-half of the collection areas collected water amounts of 0.01 gpm/ft.$^2$ or less. Also, in those same tests, two-thirds of the collection areas received less than one-half of the average density collected by all pans in the identified collection area. In many instances, a majority of the indicated collection pans collected less than one-half of the average density collected in all of the pans. It is further noted that in all of the water distribution tests no attempt was made to collect water in the first foot of the floor coverage area between the pairs of tested sprinklers. Pans were not provided to attempt to collect water in the last three feet of the six by ten or six by twenty foot floor coverage areas of water distribution tests for 4:12 roof pitches, in the last two feet of the six by thirty foot floor coverage areas of water distribution tests for the 4:12 roof pitches or in the last foot of the six by ten, twenty or thirty foot floor coverage areas of the water distribution tests for 8:12 roof pitches.

In the fire tests, sprinklers of the present invention generally performed better than standard spray sprinklers in attic installations in preventing fire from establishing itself in the decking or structure above the sprinkler(s). This accounts, in part, for the lack of structural damage sustained in the fire tests using attic sprinklers of the present invention where indicated thermocouple temperatures appear to be higher than those measured in the comparison standard spray sprinkler tests.

We claim:

1. A bidirectional sprinkler comprising:

a tubular body having an inlet, an outlet with a central axis and a waterway coupling the inlet and the outlet;

a plug releasably received in the outlet at least essentially closing the outlet;

a temperature responsive trigger releasably retaining the plug in the outlet; and a water directing structure coupled with the tubular body so as to receive water flowing from the outlet when the plug is released by the trigger, the water directing structure having at least two distinct and separate water directing channels configured and positioned to direct water outwardly from the sprinkler simultaneously in at least two distinct and different directions, the water directing structure dividing water from the tubular body substantially equally among all of the water directing channels, each channel having a water directing surface generally facing the tubular body, a tangential line projecting from a central point on each water directing surface most remote from the central axis intersecting the central axis at an acute angle of greater than 45° and less than 90°.

2. The sprinkler of claim 1 wherein the water directing structure includes a head coupling at least a first discharge nozzle with the tubular body, the first nozzle defining at least part of one of the two channels, and a surface of the first nozzle defining the tubular body facing, water directing surface of the one channel.

3. The sprinkler of claim 2 wherein the water directing structure includes at least a second discharge nozzle defining at least part of a second one of the at least two channels.

4. The sprinkler of claim 3 wherein the acute angle formed by the tangential line projecting from the tubular body facing, water directing surface of the second nozzle is substantially equal to the acute angle formed by the projection from the first nozzle.

5. The sprinkler of claim 4 wherein tangential lines projecting from the first and second nozzles are coplanar with the central axis of the outlet.

6. The sprinkler of claim 4 wherein projections of the tangential lines from the tubular body facing, water directing surfaces of the first and second nozzles on a plane perpendicular to the central axis of the outlet extend in generally mutually perpendicular directions.

7. The sprinkler of claim 2 wherein at least a portion of the first nozzle has an essentially closed perimeter defining an enclosed part of the one channel.

8. The sprinkler of claim 1 wherein at least a portion of each of the channels is defined by an at least essentially closed perimeter opening in the water-directing structure.

9. The sprinkler of claim 1 wherein the water directing structure includes an open deflector coupled with the tubular body, the deflector being positioned opposite the outlet to directly receive water flowing from the outlet and shaped to define the at least two channels.

10. The sprinkler of claim 9 having only two water directing channels, the two channels being generally diametrically opposed, and the water directing structure further including a convex, generally semicylindrical, water directing surface directly opposite the outlet of the tubular body and centered with respect to the central axis.

11. The sprinkler of claim 10 wherein the open deflector includes a central portion with the semicylindrical surface, wherein each of the two water directing channels are parts of the open deflector extending away from the central portion, and wherein each channel further includes sidewalls extending transversely from the water directing surface of each channel along opposing sides of the water directing surface of each channel, the sidewalls also extending from proximal the central portion to a distal end of each channel.

12. The sprinkler of claim 11 wherein at least the open deflector of the water directing structure is formed from a resilient material, wherein the open deflector further includes cutouts in the sidewalls of each channel reducing the height of each sidewall proximally where the sidewall adjoins the central portion of the open deflector sufficiently to permit the acute angle between the water directing surface and the central axis of each channel to be adjusted by bending the resilient material forming each channel.

13. The sprinkler of claim 1 wherein each channel discharges water outwardly from the sprinkler in one of the two distinct and different directions a distance greater than a spread of the discharged water in a horizontal direction perpendicular to the one direction.

14. The sprinkler of claim 1 in combination with a water supply line supporting the sprinkler beneath and proximal a peak of an interior overhead wall, the peak being defined by an intersection of at least two adjoining pitched portions of the overhead wall extending downwardly and outwardly from the peak, the sprinkler being oriented such that the two distinct and different directions of the directed water extend downwardly and outwardly from the sprinkler and the peak at least generally along the two adjoining pitched portions of the overhead wall.

15. The combination of claim 14 wherein the water directing structure includes an open deflector facing the outlet and defining the two channels, each of the deflector channels having a center line and the center lines of the deflector channels being generally coplanar with the central axis of the outlet.

16. The combination of claim 14 wherein the water directing structure includes first and second discharge nozzles, each nozzle defining at least part of a separate one of the two channels, each nozzle having a centerline and the centerlines of the first and second nozzles being generally coplanar with the centerline of the outlet.

17. The combination of claim 14 wherein structural members project downwardly from the overhead wall and laterally away from the peak in opposing directions to define a first pair of opposing courses extending downwardly and outwardly away from the peak, the sprinkler being located sufficiently proximal to the peak such that the two distinct and different directions extend generally along each of the pair of opposing courses.

18. The combination of claim 17 further comprising a second, substantially identical bidirectional sprinkler fluidly coupled with the water supply line beneath and proximal to the peak, the second bidirectional sprinkler being configured to discharge and direct water outwardly from the second sprinkler simultaneously in two distinct and different directions parallel to the distinct and different directions of the first stated bidirectional sprinkler.

19. The combination of claim 14 further comprising a second bidirectional sprinkler fluidly coupled with the water supply line beneath and proximal to the first stated bidirectional sprinkler, the second bidirectional sprinkler being configured to discharge and direct water outwardly from the second sprinkler simultaneously in two distinct and different directions generally perpendicular to one another.

20. The combination of claim 14 further comprising a unidirectional sprinkler fluidly coupled with the water supply line, the unidirectional sprinkler including a tubular body having an inlet, an outlet with a central axis, a waterway coupling the inlet and the outlet, a plug releasably received in the outlet at least essentially closing the outlet, a temperature responsive trigger releasably retaining the plug in the outlet, and a water directing structure coupled with the sprinkler body so as to receive water flowing from the outlet when the plug is released by the trigger, the water directing structure having one distinct water directing channel configured and positioned to direct water outwardly from the sprinkler in only one direction transverse to the central axis of the second sprinkler outlet, the one channel having a downwardly facing, water directing surface, extending transversely outwardly from the central axis in a direction at least generally paralleling one of the two distinct and different directions of the bidirectional sprinkler.

21. The combination of claim 14 wherein at least one of the water directing surfaces of the water directing structure is generally downwardly facing.

22. The combination of claim 21 wherein each of the water directing surfaces of the water directing structure is generally downwardly facing.

23. The bidirectional sprinkler of claim 1 in combination with a water supply line located proximal to a peak of an interior overhead wall within a building, the peak being defined by an intersection of at least two adjoining pitched portions of the overhead wall extending downwardly and outwardly from the peak, the sprinkler being supported by the supply line beneath and proximal to the peak of the overhead wall with the two distinct and different directions extending outwardly from the sprinkler and generally along the two adjoining pitched portions of the overhead wall sufficiently closely to the portions so as to distribute water over two areas of the overhead wall, each area extending outwardly away from the sprinkler in one of two distinct and different directions a distance greater than a distance each area extends in a direction horizontally perpendicular to the one of the two directions.

24. The combination of claim 23 further comprising a second sprinkler supported from the water supply line spaced from the bidirectional sprinkler.

25. The combination of claim 24 wherein the second sprinkler is a bidirectional sprinkler substantially identical to the first stated bidirectional sprinkler.

26. The combination of claim 25 wherein each of the first stated and second bidirectional sprinklers discharge water in generally opposing directions.

27. The combination of claim 24 wherein the second sprinkler is bidirectional and includes a water directing structure coupled with a sprinkler body so as to receive water flowing from an outlet of the sprinkler body when the sprinkler is activated, the water directing structure having at least two distinct and separate water directing channels configured and positioned to direct water outwardly from the sprinkler simultaneously in two approximately perpendicular directions.

28. The combination of claim 24 wherein the second sprinkler is unidirectional and includes a water directing structure coupled with a tubular sprinkler body so as to receive outlet flowing from an outlet of the body when the second sprinkler is activated, the water directing structure having only one water directing channel configured and positioned to direct water outwardly from the second sprinkler in only one direction transverse to a direction of the supply line supporting the second sprinkler.

29. The combination of claim 24 wherein the second sprinkler immediately adjoins the bidirectional sprinkler on the water supply line and is spaced six feet or less along the supply line from the bidirectional sprinkler.

30. The sprinkler of claim 1 wherein each of the water directing channels extends from a central portion of the water directing structure directly opposite the outlet of the tubular body, wherein each of the channels is configured to be adjustable with respect to the central portion sufficiently to permit the acute angle between the water directing surface and the central axis of each channel to be varied by about twelve degrees or more.

31. A sprinkler system used beneath an interior overhead wall having a peak defined by an intersection of at least two adjoining pitched portions of the overhead wall extending downwardly and outwardly from the peak comprising:

a water supply line located beneath and proximal to the peak; and a plurality of sprinklers coupled to the supply line and located beneath the peak proximal the peak, each of the sprinklers having two distinct and separate water directing channels configured and oriented with respect to the peak to direct water outwardly from each sprinkler simultaneously and continuously in two distinct and different directions extending downwardly and outwardly from the sprinkler and from the peak and at least generally along each of the two adjoining pitched portions of the overhead wall.

32. The sprinkler system of claim 31 wherein the two distinct and different directions are about 180° apart.

33. The sprinkler system of claim 31 wherein the two distinct and different directions are about 90° apart.

34. The sprinkler system of claim 31 wherein the water supply pipe comprises CPVC.

* * * * *